US009079749B2

(12) United States Patent
Hsieh

(10) Patent No.: US 9,079,749 B2
(45) Date of Patent: Jul. 14, 2015

(54) SIMPLE NODE TRANSPORTATION SYSTEM AND NODE CONTROLLER AND VEHICLE CONTROLLER THEREIN

(75) Inventor: Kin-Hsing Hsieh, New Taipei (TW)

(73) Assignee: VIA TECHNOLOGIES, INC., New Taipei (TW)

( * ) Notice: Subject to any disclaimer, the term of this patent is extended or adjusted under 35 U.S.C. 154(b) by 820 days.

(21) Appl. No.: 13/309,485

(22) Filed: Dec. 1, 2011

(65) Prior Publication Data

US 2012/0234631 A1 Sep. 20, 2012

(30) Foreign Application Priority Data

Mar. 15, 2011 (TW) ..... 100108680 A

(51) Int. Cl.
*B66B 1/28* (2006.01)
*B66B 3/00* (2006.01)

(52) U.S. Cl.
CPC ..... *B66B 3/002* (2013.01)

(58) Field of Classification Search
CPC .. B66B 3/002; B66B 3/006; B66B 2201/103; B66B 2201/405
USPC ..... 187/247, 391–393, 395, 396, 901; 715/863, 864; 345/158, 168, 173–175
See application file for complete search history.

(56) References Cited

U.S. PATENT DOCUMENTS 5,387,768 A * 2/1995 Izard et al. ..... 187/392
5,594,469 A * 1/1997 Freeman et al. ..... 345/158
5,767,842 A * 6/1998 Korth ..... 345/168
6,161,654 A * 12/2000 Sirigu et al. ..... 187/391
6,788,809 B1 9/2004 Grzeszczuk et al.
6,902,041 B2 * 6/2005 Eccleston ..... 187/380

(Continued)

FOREIGN PATENT DOCUMENTS

| | | |
|---|---|---|
| CN | 200981779 | 11/2007 |
| CN | 101142133 | 3/2008 |
| CN | 201626743 | 11/2010 |
| TW | I305192 | 1/2009 |

OTHER PUBLICATIONS

English language translation of abstract of CN 200981779 (published Nov. 28, 2007).

(Continued)

*Primary Examiner* — Anthony Salata
(74) *Attorney, Agent, or Firm* — McClure, Qualey & Rodack, LLP

(57) ABSTRACT

A simple node transportation system having a vehicle traveling on a route having nodes, a traditional control module controlling the vehicle, and any combination of a node controller and a vehicle controller. The node controller has a traditional touch module connecting to the traditional control module and sending a control instruction to the traditional control module, an input module photographing an image and a gesture, a node control module recognizing the gesture and transferring the corresponding control instruction, and an output module displaying the image and the corresponding control instruction. The vehicle controller has a traditional touch module connecting to the traditional control module and sending a control instruction to the traditional control module, an input module photographing an image and a gesture, a vehicle control module recognizing the gesture and transferring the corresponding control instruction, and an output module displaying the image and the corresponding control instruction.

10 Claims, 18 Drawing Sheets

(56) References Cited

U.S. PATENT DOCUMENTS

| | | | | |
|---|---|---|---|---|
| 7,319,967 | B2 * | 1/2008 | Meyer | 705/305 |
| 7,877,707 | B2 * | 1/2011 | Westerman et al. | 715/863 |
| 7,878,307 | B2 * | 2/2011 | Newville et al. | 187/396 |
| 8,705,872 | B2 * | 4/2014 | Ivanich et al. | 382/209 |
| 2012/0168262 | A1 * | 7/2012 | Finschi | 187/392 |
| 2012/0175192 | A1 * | 7/2012 | Tsou | 187/247 |
| 2014/0014444 | A1 * | 1/2014 | Kauppinen et al. | 187/389 |
| 2014/0094997 | A1 * | 4/2014 | Hyde et al. | 701/2 |

OTHER PUBLICATIONS

English language translation of abstract of CN 101142133 (published Mar. 12, 2008).

English language translation of abstract of CN 201626743 (published Nov. 10, 2010).

English language translation of abstract of TW I305192 (published Jan. 11, 2009).

* cited by examiner

SIMPLE NODE TRANSPORTATION SYSTEM AND NODE CONTROLLER AND VEHICLE CONTROLLER THEREIN

CROSS REFERENCE TO RELATED APPLICATIONS

This Application claims priority of Taiwan Patent Application No. 100108680, filed on Mar. 15, 2011, the entirety of which is incorporated by reference herein.

BACKGROUND OF THE INVENTION

1 . Field of the Invention

The present invention relates to control methods and devices of a simple node transportation system, and in particular relates to control methods and devices of a simple node transportation system for human-machine interface.

2 . Description of the Related Art

The most common example of a simple node transportation system is a common building elevator system. In general, the transportation system includes a plurality of nodes and a vehicle. The vehicle may stop by the node to facilitate loading or unloading of people or goods. A plurality of nodes of the transportation system is usually located on a route. Except for two terminal nodes of the ends of the route, any node between the terminal nodes has two adjacent nodes. Depending on the system requirements, the vehicle may stop by the nodes which have transportation requests. Each system may comprise many transportation routes and vehicles corresponding to transportation routes, those may be controlled by a control center.

Take the vertical moving elevator transportation system as an example; each floor with an entrance door of the elevator is regarded as a node. The elevator transportation system may comprise one elevator shaft and an elevator, or many elevator shafts and many elevators. More than one elevator route may share a set of the nodes that the elevators stop by. For example, two elevators both stop at the first floor; one of the two elevators stops at odd floors and the top floor, and the other stops at even floors and the top floor. In another example, the floors at which the two elevators stop at are the same.

There are two control types of a simple node transportation system. The first type may be called as intelligent transportation system, which installs a complex control interface at each node. The user can input the target node which he wants to go, and the control center of the system dispatches a vehicle to stop by the node where the user fed input. After the vehicle carries users and/or goods, the control center of the system sends a signal to the vehicle for going to the target node. In transit, the vehicle may stop by other nodes due to other requests, but users and/or goods would only leave the vehicle at the target node. Except for an emergency interface in the vehicle, the vehicle may not be equipped with any control interface. The user only needs to input a command once at the node. Besides, the user does not need to care about the relative direction of the target node. This is why the system called intelligent transportation system.

The second type is more traditional, the system installs a simpler control interface in each node, and the user has to determine by himself the direction of the node to which he wants to go and inputs the direction in the control interface. The control center of the system dispatches a vehicle to stop by the node which the user has input. The user has to determine whether it goes the desired direction when vehicular door opens. After the user enters the vehicle, the user has to input the target node to which he wants to go by a complicated control interface in the vehicle. This type of transportation system requires two-stage inputs, wherein the user inputs the direction of the route at the node in the first stage, and inputs the target node in the vehicle in the second stage.

In practice, due to the number of nodes on the same route being usually more than the number of the vehicles, only a simple interface is installed in each node with one complicated interface installed in the vehicle, the second type is more economical than the first type. Therefore, the installation number of second type transportation system is greater than the first type actually.

Since the development of consumer electronic systems explores in recent years, the electronic systems have made significant progress, and prices have fallen very rapidly. Therefore, there is a need for integrating several features into the aforementioned human-machine interface of a simple node transportation system through electronic systems, such as advertisement, communication, security, monitoring, warnings, and so on.

BRIEF SUMMARY OF THE INVENTION

In an embodiment, the invention discloses a simple node transportation system, comprising a vehicle traveling on a route, and a traditional control module configured to control the vehicle, and any combination of a node controller and a vehicle controller, wherein the route comprises a plurality of nodes which the vehicle may stop by. The node controller is installed in one of the plurality of nodes, and the vehicle controller is installed in the vehicle.

The node controller further comprises a traditional touch module, an input module, a node control module and an output module. The traditional touch module is configured to connect to the traditional control module, and send a control instruction of a user to the traditional control module. The input module is configured to photograph an image in a target area and at least a gesture of the user. The node control module is configured to recognize the gesture, transfer the control instruction corresponding to the gesture, and output to the traditional control module. The output module is configured to display the image in the target area and the control instruction corresponding to the image.

The vehicle further comprises: the traditional touch module, the input module, a vehicle control module and the output module. The traditional touch module is configured to connect to the traditional control module, and send the control instruction of the user to the traditional control module. The input module is configured to photograph an interior image in the vehicle and at least a gesture of the user. The vehicle control module is configured to recognize the gesture, transfer the control instruction corresponding to the gesture, and output to the traditional control module. The output module is configured to display the interior image and the control instruction corresponding to the interior image.

In another embodiment, the invention discloses an intelligent control module in a simple node transportation system. The simple node transportation system comprises a vehicle traveling on a route, and a traditional control module configured to control the vehicle, wherein the route comprises a plurality of nodes, which the vehicle may stop by. The simple node transportation system comprises at least one of the following components a node controller installed in at least one of the plurality of nodes and a vehicle controller installed in the vehicle. The intelligence control module comprises a network module configured to connect to any combination of a node control module of at least one node controller and a vehicle control module of the vehicle controller, wherein the node control module or the vehicle control module gets an image in the target area photographed by an input module of another node controller or an interior image photographed by the input module of the vehicle controller through the network module, and sends a signal to an output module of the node control module or the vehicle control module to display the image in a target area or the interior image.

In another embodiment, the invention discloses a node controller in a simple node transportation system. The simple node transportation system comprises a vehicle traveling on a route, and a traditional control module configured to control the vehicle, wherein the route comprises a plurality of nodes, which the vehicle may stop by. The node controller is installed in at least one of the plurality of nodes, and the node controller comprises: an input module, a node control module and an output module. The input module is configured to photograph an image in a target area and at least a gesture of the user. The node control module is configured to recognize the gesture, transfer the corresponding control instruction and output the control instruction to the traditional control module. The output module is configured to display the image in the target area and the corresponding control instruction.

In another embodiment, the invention discloses a vehicle controller in a simple node transportation system. The simple node transportation system comprises a vehicle traveling on a route, and a traditional control module configured to control the vehicle, wherein the route comprises a plurality of nodes, which the vehicle may stop by. The vehicle controller is installed in the vehicle, and the vehicle controller comprises: an input module, a vehicle control module and an output module. The input module is configured to photograph an interior image in the vehicle and at least a gesture of the user. The vehicle control module is configured to recognize the gesture, transfer and output the corresponding control instruction to the traditional control module. The output module is configured to display the interior image in the vehicle and the corresponding control instruction.

In another embodiment, the invention discloses a control method of a simple node transportation system. The simple node transportation system comprises a vehicle traveling on a route, and a traditional control module configured to control the vehicle, wherein the route comprises a plurality of nodes, which the vehicle may stop by, and the vehicle controller is installed in the vehicle, and the control method comprises: detecting that at least one user has entered a target area of the node; detecting the gesture of the user in the target area; recognizing the gesture and transferring the corresponding control instruction, and outputting the corresponding control instruction to the traditional control module; and displaying the corresponding control instruction.

In another embodiment, a control method of a simple node transportation system is provided. The simple node transportation system comprises a vehicle traveling on a route, and a traditional control module configured to control the vehicle, wherein the route comprises a plurality of nodes, which the vehicle may stop by. The control method comprises: detecting that at least one user has entered a target area of the node; detecting the gesture of the user in the target area; recognizing the gesture and transferring the corresponding control instruction, and outputting the corresponding control instruction to the traditional control module; and displaying the corresponding control instruction.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
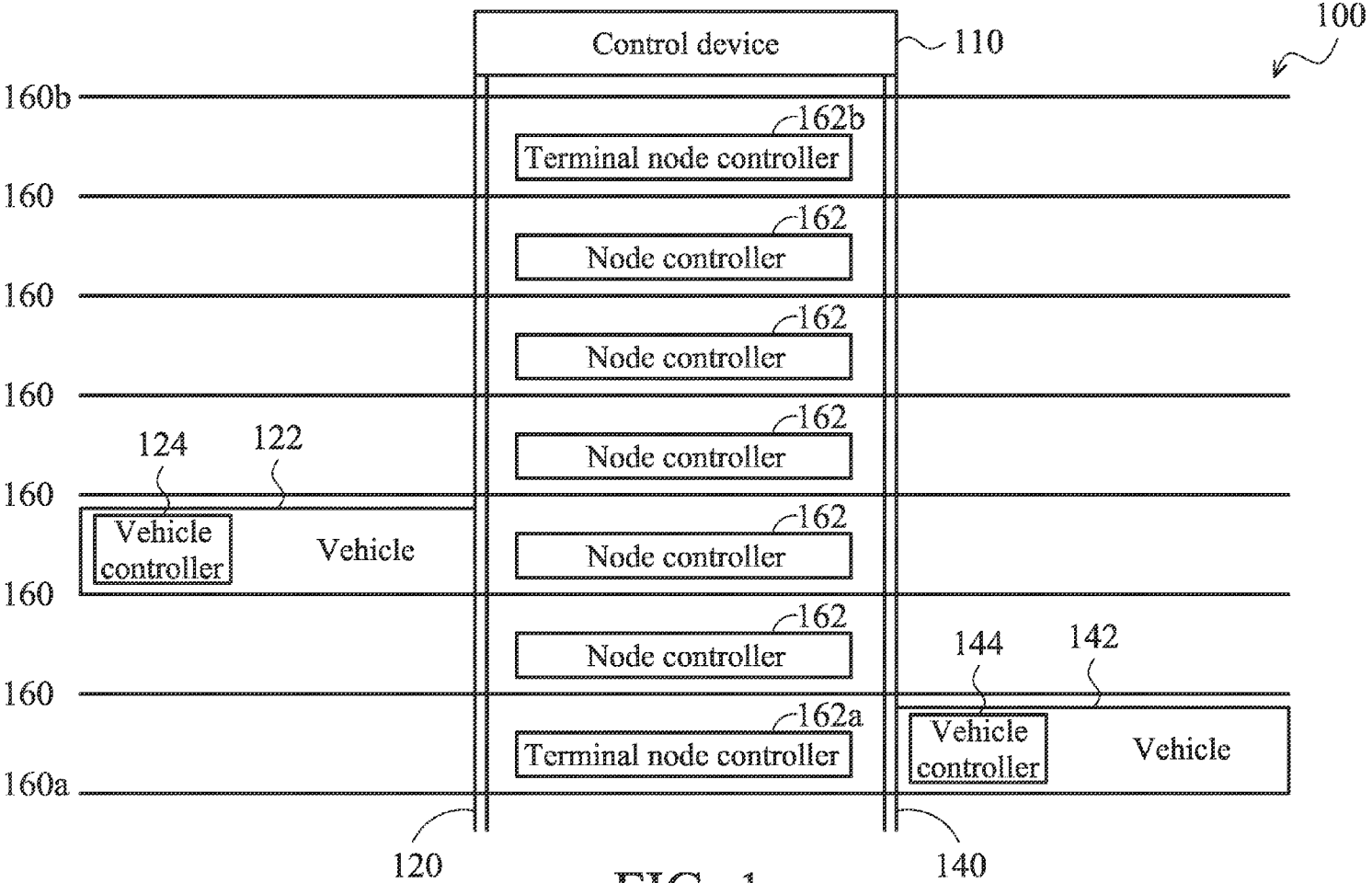
FIG. 1 is a schematic diagram illustrating an embodiment of a simple node transportation system of the disclosure.

Please refer to FIG. 1. FIG. 1 is a diagram illustrating a simple node transportation system 100 according to an embodiment of the invention. The transportation system 100 comprises two routes 120 and 140, and two vehicles 122 and 142. The vehicle 122 travels on the route 120, and the other vehicle 142 travels on the route 140. These two routes 120 and 140 may stop by a plurality of nodes 160, which include two terminal nodes 160*a* and 160*b* . As shown, the vehicle 142 stops by the terminal node 160*a*, and the vehicle 122 stops by the node 160.

In an example, the sets of the nodes 160 which the two routes 120 and 140 stop by are the same. In another embodiment, the sets of the nodes 160 which the two routes 120 and 140 stop by are different, but at least share one common node 160.

Each node 160 is equipped with a node controller 162 as a human-machine interaction interface. The terminal nodes 160*a* and 160*b* are equipped with the terminal node controllers 162*a* and 162*b* . The vehicles 122 and 142 are equipped with a respective vehicle controller 124 and 144 as a human-machine interaction interface. The node controller 162 and the vehicle controllers 124 and 144 are connected to a control device 110. The control device 110 controls the vehicle controllers 124 and 144 according to the instructions received from the human-machine interface; and the control device 110 demands the vehicle controllers 124 and 144 to travel between the nodes 160 on the route and stop by the nodes 160 to load and unload people and goods. The nodes 160 and the vehicles 122 and 142 may be equipped with security doors (not shown), the control device 110 may also control the security doors for opening/closing.

Figure 2:
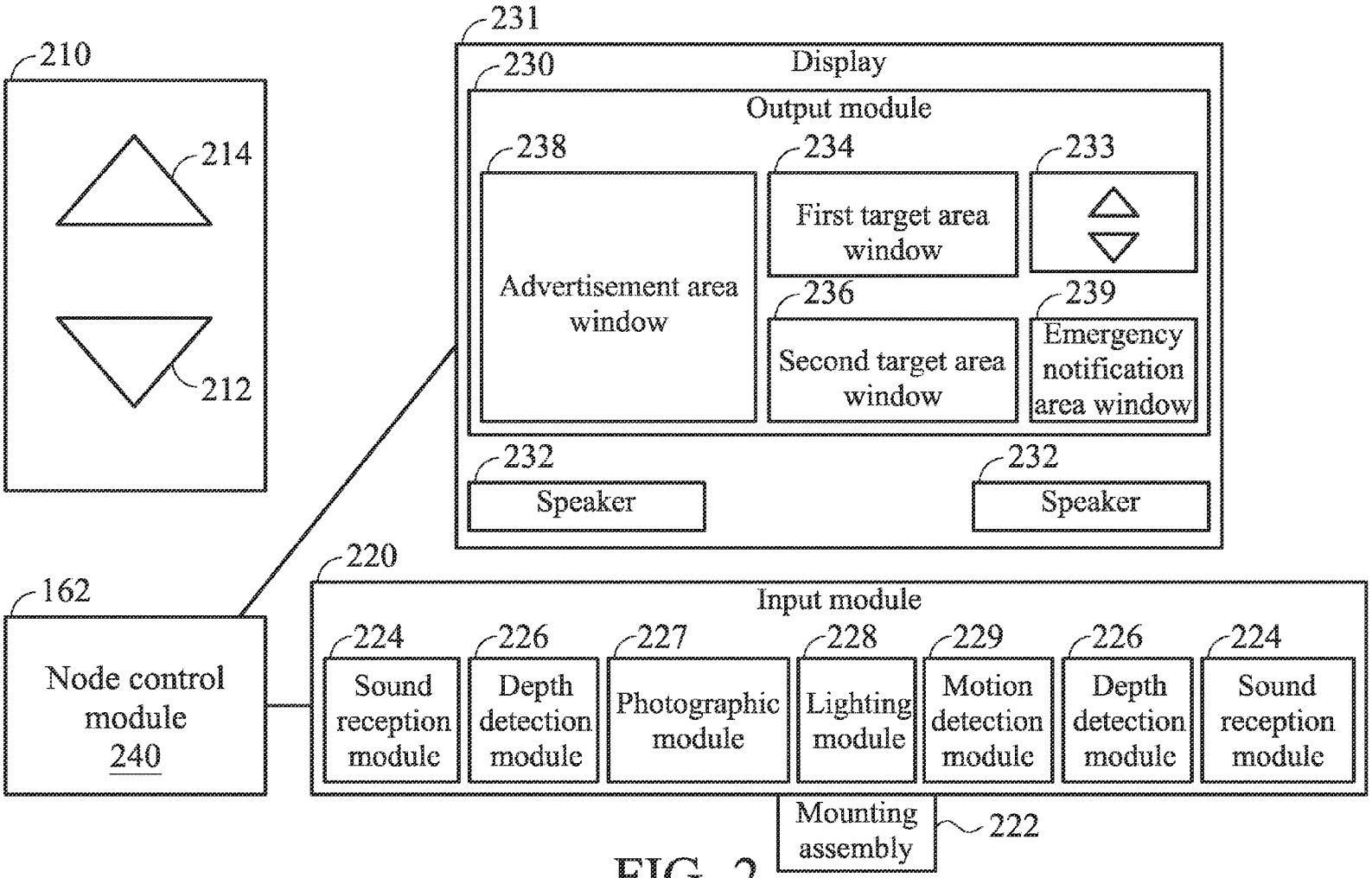
FIG. 2 is a schematic diagram illustrating an embodiment of a node controller of the disclosure.

Please refer to FIG. 2. FIG. 2 is a diagram illustrating a node controller 162 according to an embodiment of the invention. The node controller 162 comprises a traditional touch module 210, an input module 220, an output module 230, and a node control module 240.

The traditional touch module 210 comprises a panel and the buttons with the direction indicator lights 212, and 214. The operation mode of the traditional touch module 210 is similar to the second type described in the description of the related art. The user first determines which direction of the target node he wants to go toward, and presses the button with the direction indicator light 212 or 214 corresponding to the direction, and then the button with the direction indicator light 212 or 214 lights up. After the vehicle arrives at the target node and opens the security doors, the button with the direction indicator light 212, or 214 goes off. User keeps pressing the button on the direction indicator light 212 or 214 to make the security doors of the vehicle keep open.

The input module 220 and the output module 230 are connected to the node control module 240. The input module 220 may comprise a mounting assembly 222 to attach the input module 220 to a proper location. The mounting assembly 222 may comprise a control mechanical equipment such that the whole input module 220 could be pitched and/or rotated in one-dimensional or multi-dimensional degrees of freedom. The input module 220 may comprises one or more of sound reception module 224 to receive monaural or multi-channel stereophonic sound. When the received volume is larger than a threshold value, the sound reception module 224 may send a signal to activate the whole or a part of the node controller 162. If the sound reception module 224 does not receive sound over a certain volume within a certain time period, the whole or a part of the node controller 162 may switch to energy-saving mode that may save more electricity.

Figure 19:
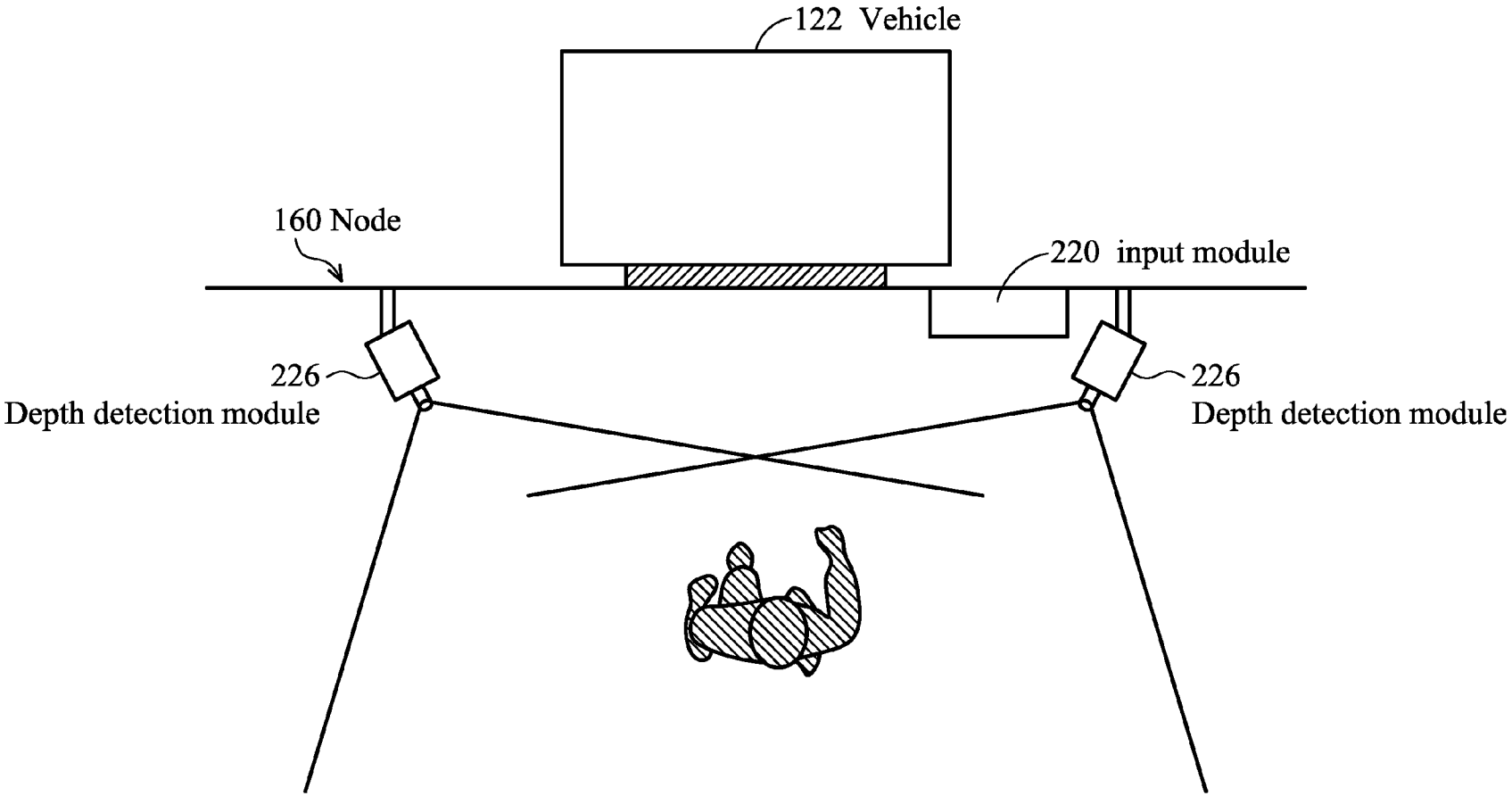
FIG. 19 is a schematic diagram illustrating an embodiment of the depth detection module detecting a depth signal of the user in the target area of the disclosure.

The input module 220 may comprises one or more of depth detection modules 226 to detect distance of presented object in front of the input module 220. The depth detection module 226 may be implemented in various manners including photographic lens that has multiple overlapping angles of vision, a laser rangefinder, an ultrasonic distance measurement device and so on. The present invention does not limit implementation choices of the depth detection module 226, as long as the implementation is capable to identify the distance between the object and the input module 220. As shown in FIG. 19, FIG. 19 is a schematic diagram illustrating an embodiment of the depth detection module detecting a depth signal of the user in the target area of the disclosure.

The input module 220 may comprise a photographic module 227 and a lighting module 228, wherein the lighting module 228 may emit the wavelength of visible light and the wavelength of infrared ray to illuminate the target area. The photographic module 227 may photograph the images in the wavelength of visible light and of infrared ray. Because there may be many complicated lighting situation for the target area photographed by the photographic module 227, the multi-spectral photography may filter out the noise to get clearer images. The photographic module 227 may also have capability for zooming out or zooming in. The input module 220 further may comprise a motion detection module 229. When object goes into or through the target area, the motion detection module 229 may send a signal to activate all or a part of the whole input module 220 or the node controller 162 to start via the node control module 240. However, if no object goes into or through the target area within a certain period of time, all or a part of the node controller 162 may switch to the energy-saving mode that may save more electricity.

The depth detection module 226 may delimit the interesting distance between the target area and the input module 220. In an embodiment, if the target area is an open area in front of the input module 220, there may be many people walking around in the target area. If the input module 220 only uses the photographic module 227 and/or the motion detection module 229, the target area may be too large. Therefore, the depth detection module 226 may be configured to restrain the depth of the target area to avoid the misjudgment resulting from the object moving behind the target area.

The node control module 240 is configured to receive the signal input from each module in the input module 220, and further may process and output the signal. The part of signal processing may comprise at least three levels. The first level may comprise signal sampling, compression, format conversion, storage, and re-output. For example, the sound reception module 224 outputs the signal to the node control module 240, and the node control module 240 may perform sampling, compression, format conversion, storage, and re-output of the audio signal. The photographic module 227 outputs the signal to the node control module 240, and the node control module 240 may perform sampling, compression, format conversion, storage, and re-output of the video signal. The depth detection module 226 outputs the signal to the node control module 240, and the node control module 240 may perform sampling, compression, format conversion, storage, and re-output of the depth signal.

The second level is the node control module 240 performing data fusion or integration between different media or related processing. For example, the node control module 240 laps the video signal over the depth signal or performs the related processing, and outputs a three-dimensional video signal. In addition, the node control module 240 may integrate the video signal with the depth signal or performs the related processing, and outputs a three-dimensional video signal animation.

The third level of the signal processing involves the recognition of the media content; especially when the node control module 240 uses the data fusion or integration of two or more media or related processing to recognize people and gesture in the target area. When the signal output from the photographic module 227 and/or the signal output from the depth detection module 226 are integrated into the output signal, the node control module 240 at least can perform face recognition and gesture recognition for people. Face recognition comprises at least position recognizing art and characteristic recognizing art. The characteristic recognizing art used to recognize the gender, the identity or the approximate age of the user through the characteristics of faces is more sophisticated than the position recognizing art used to recognize the positions where faces are. In additional to recognizing so-called hard point such as the center of a palm and/or finger tips, the recognition may include the vertices of the face, elbows, shoulders, neck, hips, knees and other vertices. The lines between corresponding vertices and recognized human parts form a skeleton of a human body. With the change of the time axis, the node control module 240 may recognize the movements of the human body, such as raising hands, waving hands, shaking hands and so on. According to the node control module 240 in this embodiment of the invention, the node control module 240 may perform the three levels of the signal processing.

The output module 230 comprises a display 231 and more than one speaker 232. The display 231 may show separate windows, which comprise a first target area window 234 configured to display the situation of the target area corresponding to the node controller 162.

Figure 3:
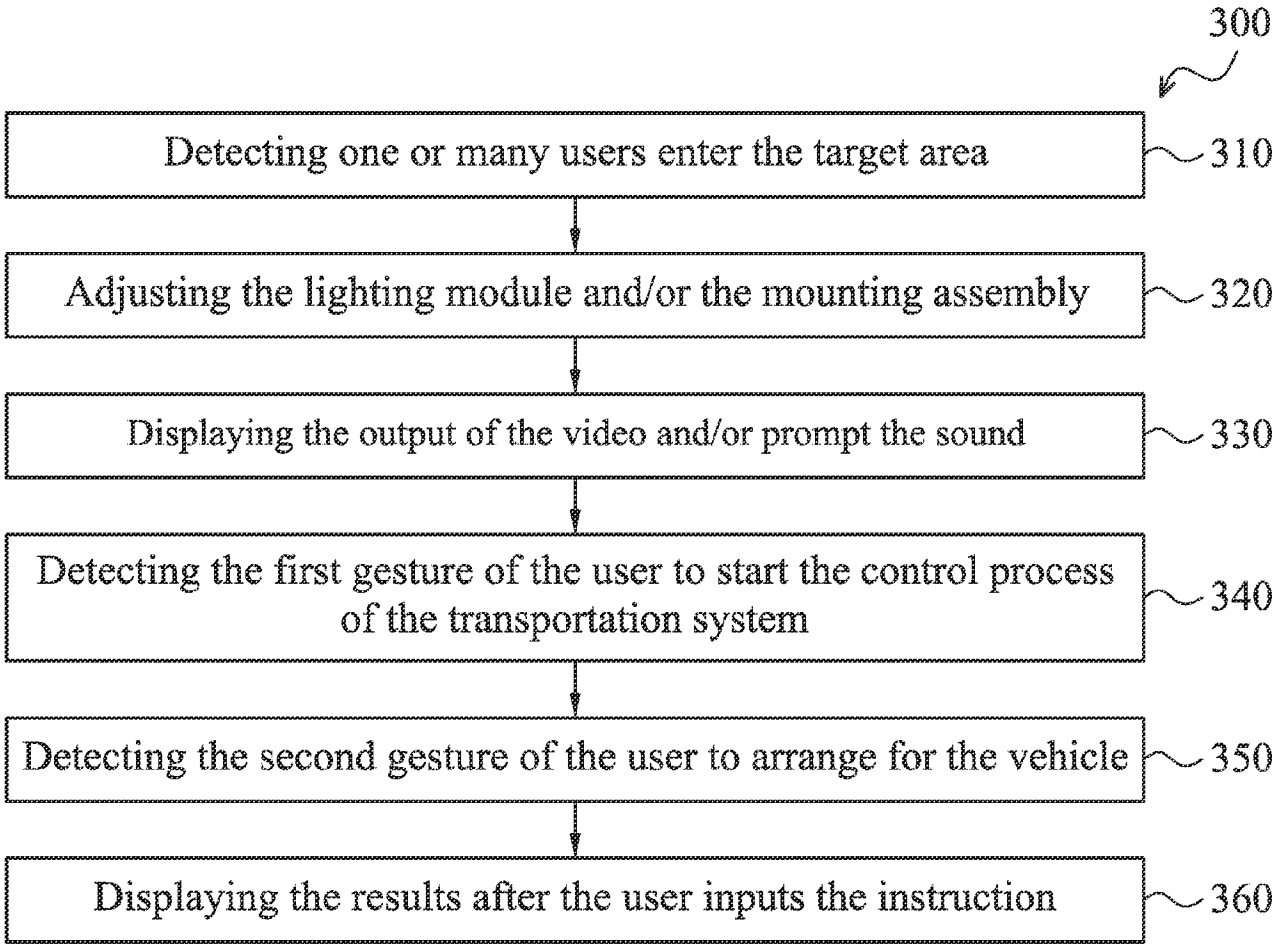
FIG. 3 is a flowchart of an embodiment of a user control method of the disclosure.
Figure 13B:
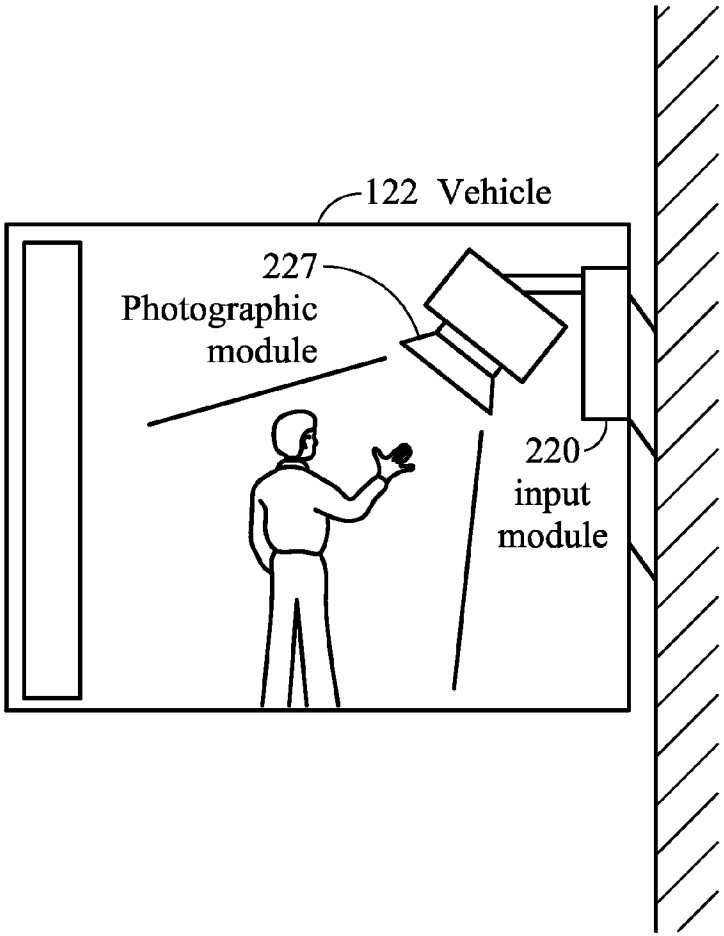
FIGS. 13A and 13B are diagrams illustrating user control of a node controller and a vehicle controller, respectively.
Figure 13A:
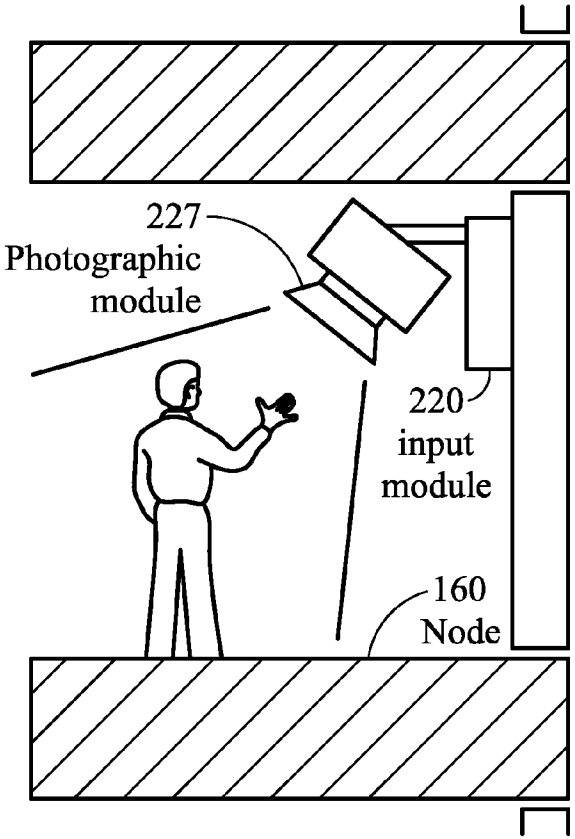

Next, please refer to the FIG. 3, which is a flowchart of a user control method 300 according to an embodiment of the invention. The user may control the node controller 162 installed in the node 160 according the method 300, as shown in FIG. 13A. In step 310, the node control module 240 may detect that one or many users have entered the target area where the node controller 162 is located by the sound reception module 224, the motion detection module 229 and/or the photographic module 227. Next, in an optional step 320, the node control module 240 may adjust the lighting module 228 for lighting the target area to make the photographic module 227 photograph the illuminated target area clearly. The node control module 240 may also adjust the direction of the mounting assembly 222 to make the photographic module 227 focus on the user in the target area clearly.

In step 330, the node control module 240 sends the image photographed by the photographic module 227 to the first target area window 234 of the display 231. Furthermore, the node control module 240 may also remind the user that he has entered the target area where the node controller 162 is located by the speaker 232. In an embodiment, the node control module 240 may recognize the characteristics of the user and mark the characteristics according to the three levels of the signal processing. The manners of marking the characteristics may comprise but not be limited to the following manners: framing the human face; displaying the user's ID or name if the node control module 240 has recognized the identity of the user; and/or verbally greeting the user by user's ID or name. For example, the node control module 240 produces a voice of "someone, hello, may I ask you to go upstairs or downstairs?" through the speaker 232; marks the control hard points like the palm of hands /fists /fingers and so on; and marks the vertices of each joint of the human body and the lines between corresponding vertices.

Figure 17:
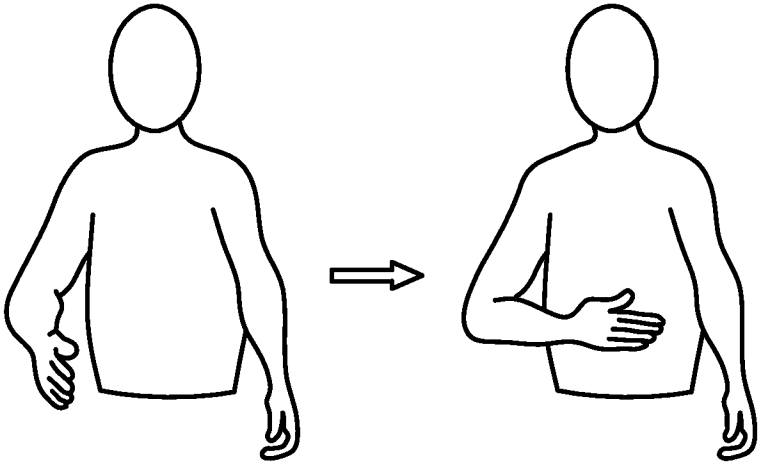
FIG. 17 shows a first gesture of raising the right hand or waving the right palm.
Figure 16:
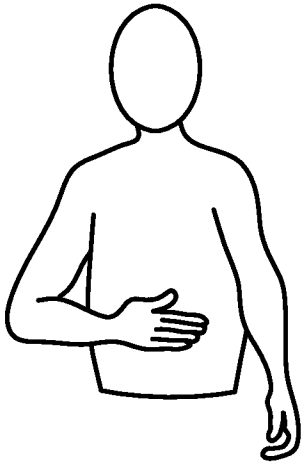
FIG. 16 shows a static gesture, such as raising the right hand.

Next, in step 340, the node control module 240 detects the first gesture of the user to start the control process of the transportation system. The first gesture mentioned in the invention may comprise a static gesture, such as raising the right hand in FIG. 16, and may also comprise a dynamic action, such as waving the right palm, holding or opening a fist, and may also comprise static gestures and dynamic actions, such as raising the right hand and doing the pose of holding or opening the fist. In step 330, the node control module 240 may also prompt the user to do the first gesture by the sound or the image, and makes the user that uses the node controller 162 at the first time or are not familiar with the operation of the node controller 162 operate smoothly. In one embodiment, the first gesture may comprise plural kinds of gestures and/or actions, such as raising the right hand or waving the right palm in FIG. 17. As long as the user does one of the gestures, the node control module 240 regards the gesture as the first gesture. Similarly, after detecting that the user does the first gesture, the node control module 240 may frame the user specially, make a sound to confirm that the user has inputted the first gesture, and guide the user to do the second gesture.

In an embodiment, the second gesture may comprise the plural kinds of gestures and/or actions. For example, the gesture of turning the palm up and the gesture of turning the palm down would correspond to the two directions of the movement of the vehicle respectively. In another embodiment, the second gesture may comprise the positions in which the control hard points of the user are showed in the display 231. For example, the user moves the control hard points to the direction control area 233 in the display 231 within a period of time or does the gesture of clenching the fist/finger splay. In step 350, the node control module 240 detects the second gesture of the user to arrange for the vehicle. The effect is like pressing the button with the direction indicator light 212, or 214 of the traditional touch module 210, wherein the operation mode is the second type described in accordance with the prior art.

Figure 14:
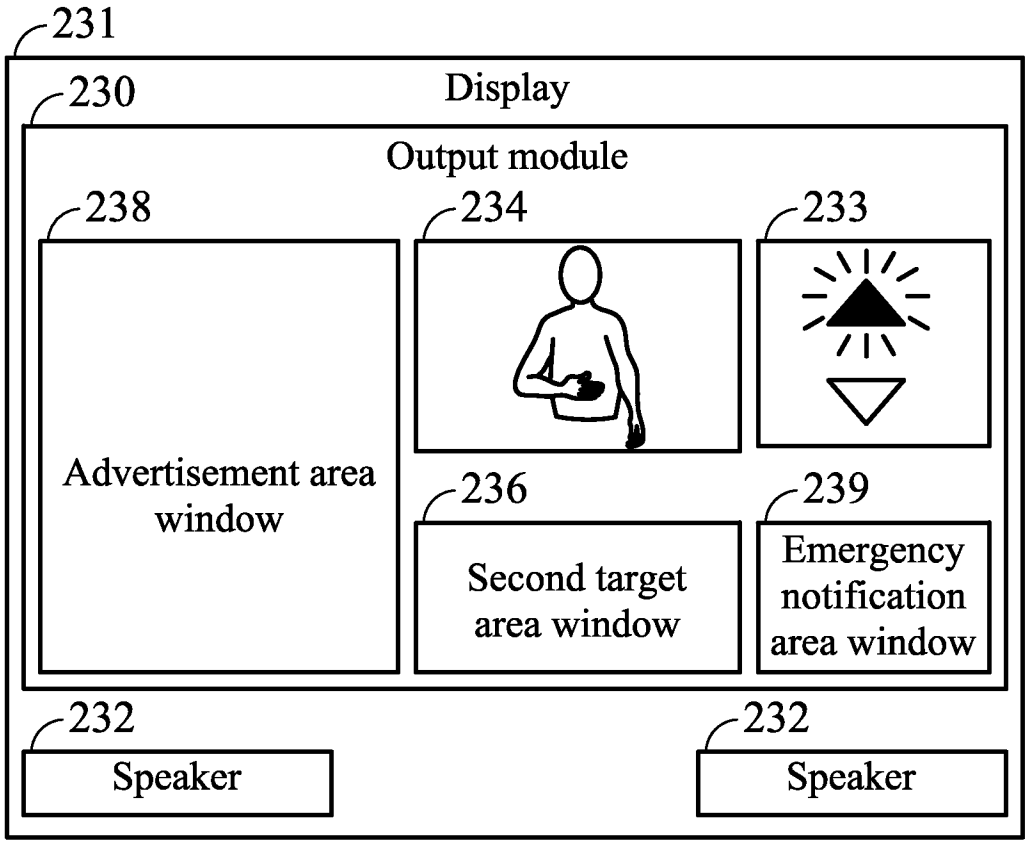
FIG. 14 is a diagram illustrating a display in accordance with an embodiment of the invention.

Finally, in step 360, the node control module 240 may turn on the light corresponding to the direction in the direction control area 233 of the display 231, and may also make a sound to confirm the direction, and may turn on the button with the direction indicator light 212, or 214 corresponding to the direction in the traditional touch module 210, as shown in FIG. 14.

In a similar example, if the user wants to cancel the previous instructions, the node control module 240 may detect the third gesture of the user, and then turn off the light corresponding to the direction light in the direction control area 233 of the display 231, and also make a sound to confirm the direction, and turn off the button with the direction indicator light 212, or 214 corresponding to the direction in the traditional touch module 210.

In another embodiment, many users can operate the node controller 162 simultaneously. For example, the first user and the second user may operate the operation of inputting two directions simultaneously, as long as the target area may accommodate many users, and the node controller 162 may analyze the gestures and actions. In other words, the input method 300 used by two or more users may be used in different steps. For example, when the input method 300 used by the first user stays in step 330, the input method 300 used by the second user may proceed as in the step 350.

Back to FIG. 2, in many windows of the display 231, in addition to the direction control area 233 and the first area window 234 introduced before, the display 231 may comprise a second target area window 236, an advertisement area window 238 and an emergency notification area window 239. The second target area window 236 is configured to display the node which the vehicle stops by, and the situation of the target area of the node. In FIG. 1, for example, assume that the movement direction of the vehicle 122 is downward, and the movement direction of the vehicle 142 is upward. In any node 160 or 160*b*, after the user inputs the instruction that the direction is upward, the second target area windows 236 of these node controllers 162 display information that the node that the vehicle 142 stopped by is 160*a* and the audio and video recorded by the input module 220 of the node controller 162*a* . When the vehicle 142 does not appear, the user in each node can monitor the current situations of the vehicle 142 through the second target area window 236.

The advertisement area window 238 may broadcast the wireless television programs, the programs stored in advance, a temporary scrolling text marquee advertisement and so on. Furthermore, the advertisement area window 238 may interact with the user by playing the simple gesture game. For example, stretching exercises, throwing or catching a ball, dancing and so on. As long as the user does not use the first and second gestures of the transportation system in the game, the node controller 162 may even allow the user to play the game and operate the control method of the transportation systems at the same time.

Finally, the emergency notification area window 239 is configured to allow the user to start the emergency notification area window 239 through an emergency gesture when the user encounters an emergency. The emergency gesture may be a "full time" gesture. It means that no matter when it is, as long as the node control module 240 detects that any person in the target area does this emergency gesture, then the node control module 240 enters the situation of the emergency notification. In another embodiment, as long as the node control module 240 detects that the hard points of the user have moved into the emergency notification area 239 and the emergency gesture is formed by the hard points, the node control module 240 would enter the situation of the emergency notification. After the node control module 240 enters the situation of the emergency notification, the user can talk to the handler who deals with the emergency through the sound reception module 224 of the input module 220, the photographic module 227 and the output module 230. In the situation of the emergency notification, the node control module 240 records and stores the audio, video, and even the depth of the signal for retrieving the records in the aftermath.

It is noted that, although FIG. 3 shows that the control method 300 includes step 340 and step 350, wherein step 340 and step 350 detect the first gesture and the second gesture of the user respectively, the reason of detecting the first and the second gesture is to reduce the probability of the misjudgment. In another embodiment of the invention, after detecting directly the second gesture of the user, the node control module 240 may arrange for the vehicle immediately.

Figure 4:
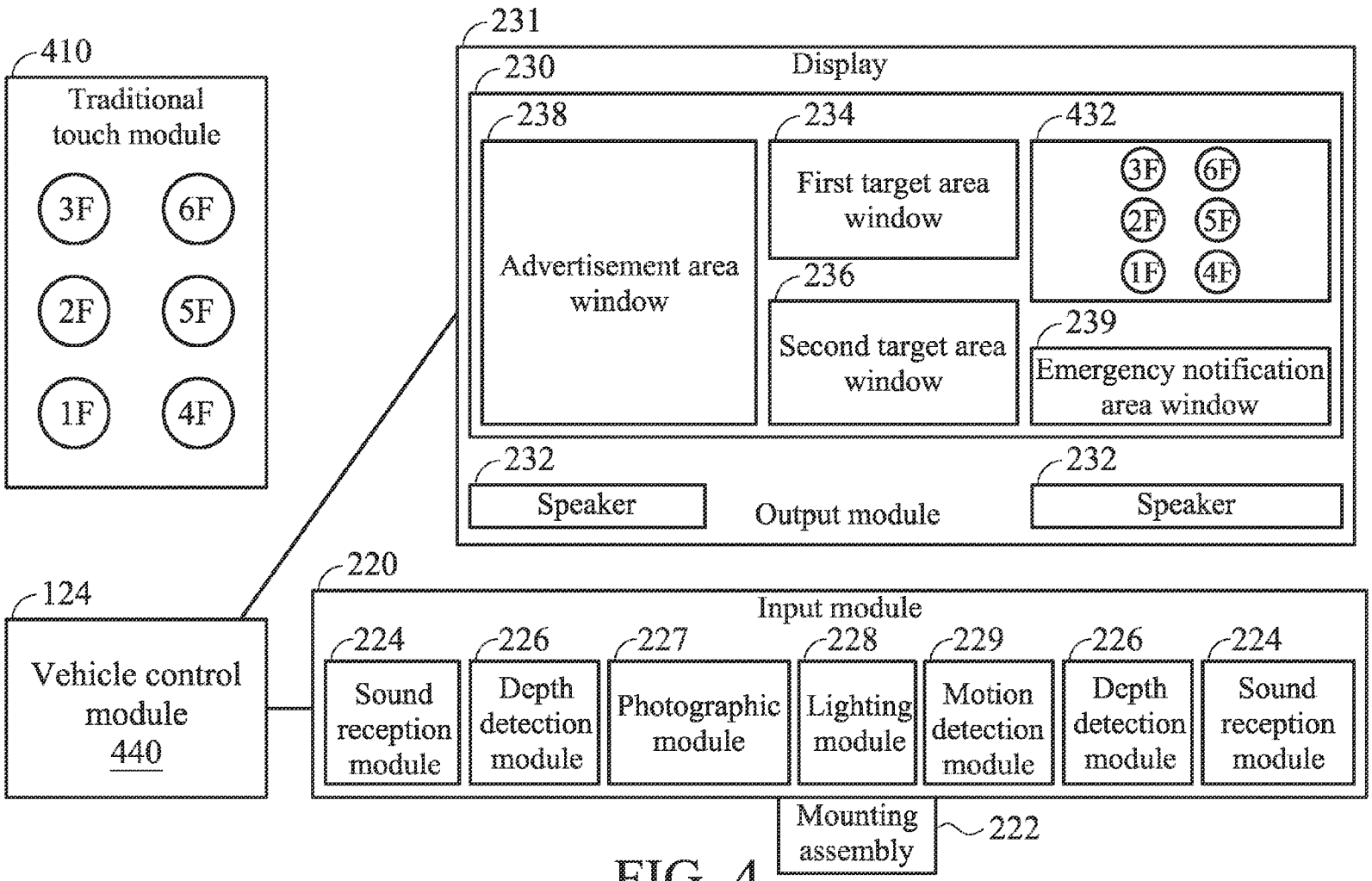
FIG. 4 is a schematic diagram illustrating an embodiment of a vehicle controller of the disclosure.

Please refer to FIG. 4, which shows a diagram illustrating a vehicle controller 124 according to an embodiment of the invention. The vehicle controller 124 or 144 comprises four modules, which are a traditional touch module 410, an input module 220, an output module 230 and a vehicle control module 440, respectively. The input module 220 and the output module 230 are connected to the vehicle control module 440 respectively.

The traditional touch module 410 comprises a panel and a plurality of buttons with the direction indicator lights. In this example, a plurality of nodes represent the first floor to the sixth floor respectively, and therefore 1F~6F represent the first floor to the sixth floor. The operation mode of the traditional touch module 410 is similar to the second type described in the description of the related art, the user first determines which direction of the target node he wants to go toward, and presses the button with the direction indicator light corresponding to the direction, and then the button with the direction indicator light lights up.

The input module 220 of the vehicle controller 124 and the input module 220 of the node controller 162 are the same basically, so the input module 220 is not mentioned here. The output module 230 of the vehicle controller 124 and the output module 230 of the node controller 162 are the same basically. The different part is that the direction control area 233 of the display 231 is changed to a node indicating area 432. The node indicating area 432 displays the node corresponding to the traditional touch module 410. In the above example, the node indicating area 432 shows that six nodes represent the first to the sixth floor respectively.

Figure 5:
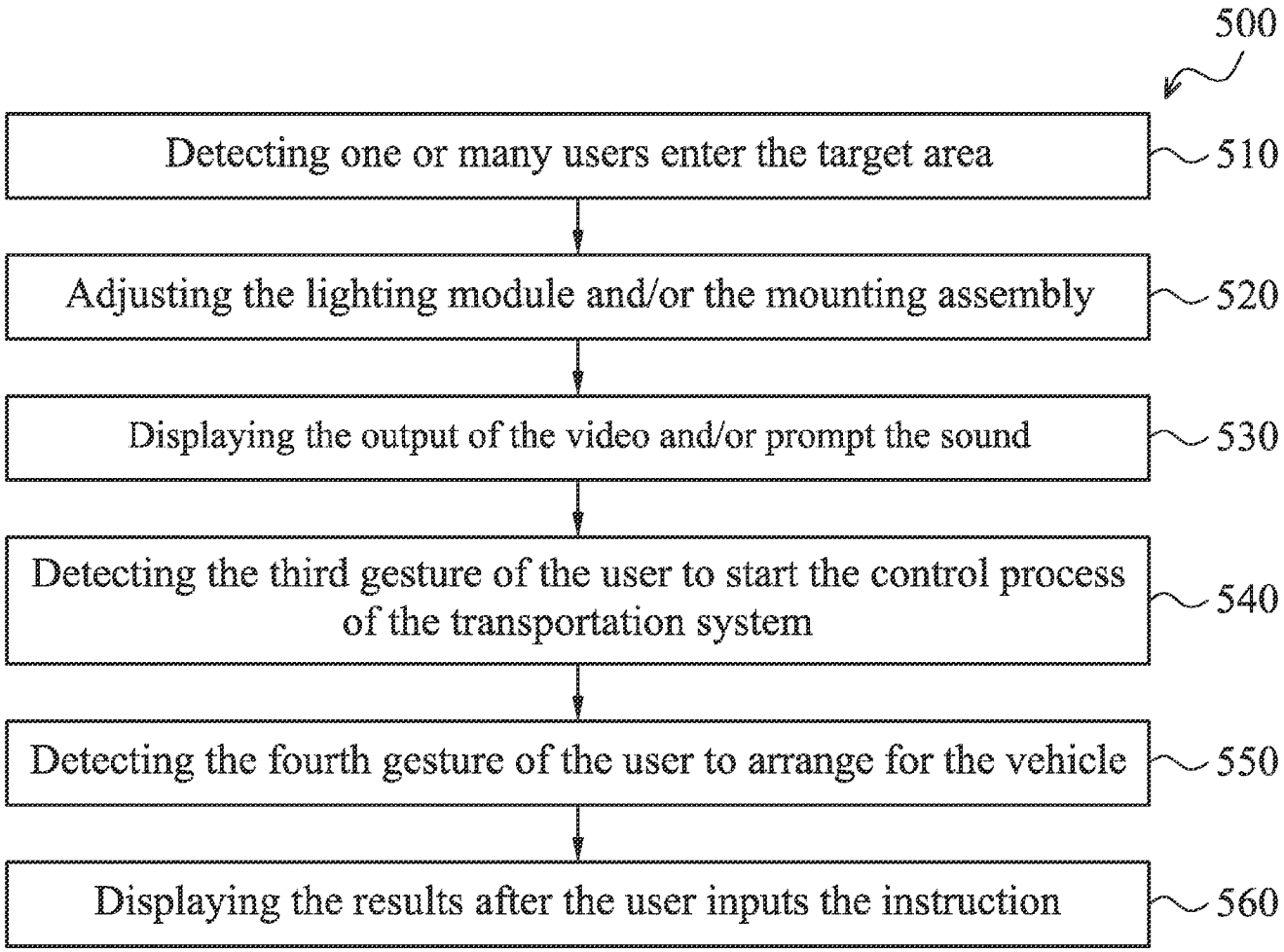
FIG. 5 is a flowchart of an embodiment of a user control method of the disclosure.

Please refer to FIG. 5, which shows a diagram illustrating a user control method 500 according to an embodiment of the invention. The user may control the vehicle controller 124 installed in the vehicle 122 according the method 500, as shown in FIG. 13B. The control method 500 is quite similar to the control method 300, and for most of the control method 500 may be referenced to the steps of the control method 300. In step 510, the vehicle control module 440 may detect that one or many users have entered the vehicle by the sound reception module 224, the motion detection module 229 and/or the photographic module 227. Next, in an optional step 520, the vehicle control module 440 may adjust the lighting module 228 for lighting the target area to make the photographic module 227 photograph the illuminated target area clearly. The vehicle control module 440 may also adjust the direction of the mounting assembly 222 to make the photographic module 227 focus on the users in the target area clearly.

In step 530, the vehicle control module 440 sends the image photographed by the photographic module 227 to the first target area window 234 of the display 231. Furthermore, the vehicle control module 440 may also remind the user that he has entered the vehicle through the speaker 232 and let the user determine whether he needs to control the vehicle or not. In an embodiment, the vehicle control module 440 may recognize the characteristics and mark the characteristics according to the three levels of the signal processing. The manners of marking the characteristics may comprise but are not be limited to the following several manners: framing the human face; displaying the user's ID or name if the node control module 240 has recognized the identity of the user, and/or verbally greeting to the user's ID or name. For example, the node control module 240 makes a sound of "someone, hello, which floor are you going to?"; marks the control hard points like the palm of hands/fist /fingers and so on; and marks the vertices of each joint of the human body and the lines between corresponding vertices.

Next, in step 540, the vehicle control module 440 detects the third gesture of the user to start the control process of the transportation system. In the step 530, the vehicle control module 440 may also prompt the user to do the third gesture by the sound or image. Similarly, after detecting that the user does the third gesture, the vehicle control module 440 may frame the user specially, make a sound to confirm that the user has entered the third gesture, and guide the user to do the fourth gesture. In an embodiment, the third gesture and the first gesture may be the same.

In an embodiment, the fourth gesture may comprise the plural kinds of gestures and/or actions. For example, the display 231 displays the route and the plurality of nodes. The user turns the palm left and turns the palm right corresponding to two directions of the movement of the vehicle, and the vehicle control module 440 may use the control hard points of the palm to choose the direction in which the user wants to go. In another embodiment, the fourth gesture may comprise the control hard points of the user in the position in the display 231. For example, the user moves the control hard points to the node indicating area 432 in the display 231 within a period of time or does the gesture of clenching the fists/finger splay, and may use the control hard points of the palm to choose the direction in which the user wants to go. In step 550, the vehicle control module 440 detects the fourth gesture of the user to arrange for the vehicle. The effect is like pressing the buttons with the direction indicator lights of the traditional touch module 410, and the operation mode is the second type described in accordance with the prior art.

Figure 15:
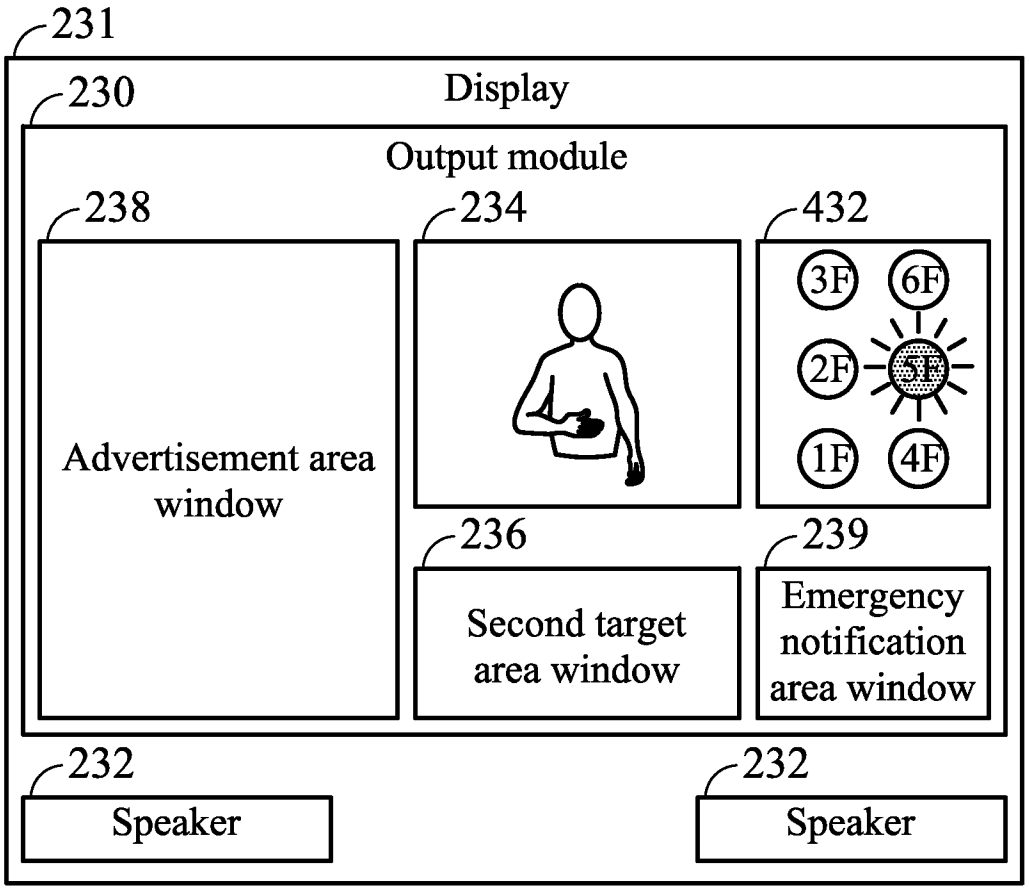
FIG. 15 is a diagram illustrating a display in accordance with an embodiment of the invention.

Finally, in step 560, the vehicle control module 440 may turn on the light of the target node in the node indicating area 432, may also make a sound to confirm, and may turn on the corresponding button with the direction indicator light in the traditional touch module 410, as shown in FIG. 15.

In a similar example, if the user wants to cancel the previous instructions, the vehicle control module 440 may detect the third gesture of the user, and then turn off the light corresponding to the target node in the node indicating area 432 of the display 231, and also make a sound to confirm, and turn off the corresponding buttons with the direction indicator lights in the traditional touch module 410.

It is noted that, although FIG. 5 shows that the control method 500 includes step 540 and step 550, wherein step 540 and step 550 detect the third gesture and the fourth gesture of the user respectively, the reason of detecting the first and the second gesture is to reduce the probability of the misjudgments. In another embodiment of the invention, after detecting directly the fourth gesture of the user, the vehicle control module 440 may arrange for the vehicle immediately.

Figure 18:
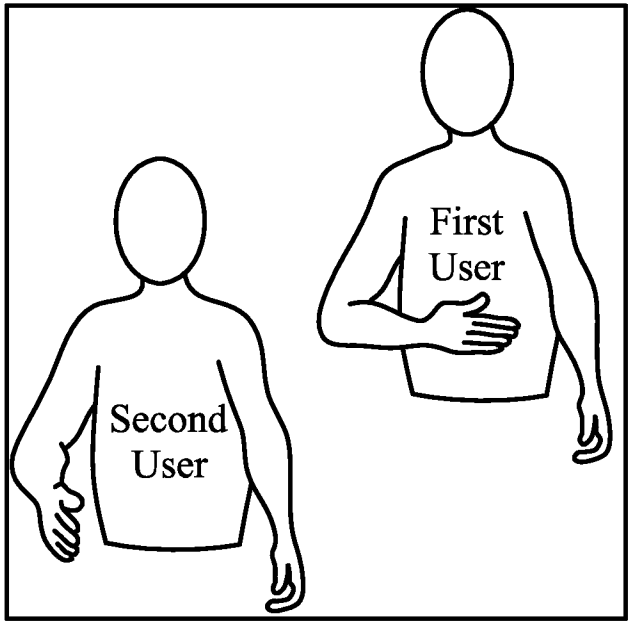
FIG. 18 shows a first user and a second user inputting two gesture directions simultaneously.

In another embodiment, many users can operate the vehicle controller 124 simultaneously. For example, the first user and the second user operate the operation of inputting two directions simultaneously in FIG. 18, as long as the target area may accommodate many users, and the vehicle controller 124 may analyze the gestures and actions. In other words, the input method 500 used by two or more users may be in different steps. For example, when the input method 500 used by the first user stays in step 530, the input method 500 used by the second user may proceed to the step 550.

In many cases, the user attempts to enter or exit the vehicle while the security doors are closing. In general, although the security doors may be equipped with the security measures to avoid jamming people or goods, taking multiple security measures for the vehicle is still needed to keep safer. According to an embodiment of the invention, the vehicle controller 124 and the node controller 162 may set a prohibited area within a certain range from the security doors. When the security doors is closing, the photographic module 227 and/or the depth detection module 226 of the input module 220 detect that the object is in the prohibited area, and the vehicle controller 124 and the node controller 162 may open the security doors, and may also send a signal to the display 231 and the speaker 232 to issue a warning.

Although many simple node transportation systems exist in the world, the control part of the simple node transportation systems still belongs to the traditional type. According to an embodiment of the invention, minimal modification of the original simple node transportation system can be achieved. Please refer to FIG. 6, which shows a diagram illustrating each component connected in a simple node transportation system 600 according to an embodiment of the invention.

The transportation system 600 comprises a control device 110. The control device 100 further comprises a traditional control module 610 and an intelligent control module 620. The traditional control module 610 is configured to the traditional touch module 410 of the vehicle controller 124 and the traditional touch module 210 of the node controller 162. The traditional control module 610 receives the input from the user of two traditional touch modules 210 and 410, and may control the scheduling and the running of the vehicle. The traditional control module 610 may be configured to connect to a traditional network control center 640 to transmit the running situation of the transportation system 600 to the traditional network control center 640.

In this embodiment, the intelligent control module 620 is configured to the vehicle control module 440 of the vehicle controller 124 and the node control module 240 of the node controller 162. In an example, the connected-state may present a shape of a star, and the intelligent control module 620 is the center of the star, such that each vehicle control module 440 and each node control module 240 are connected to each other through the intelligent control module 620. In another example, each component is connected to each other through a bus or the Internet. No matter what the connections, each vehicle control module 440 and each node control module 240 may transmit the signals to each other, and the intelligent control module 620 may be also connected to each vehicle control module 440 and each node control module 240. The intelligent control module 620 may also be connected to an intelligent network control center 630 to receive the control signal of the intelligent network control center 630.

In this embodiment, the traditional touch module 210 of the node controller 162 and the node control module 240 are connected to each other. After receiving the input from the user, the node control module 240 gives the instruction to the corresponding direction of the traditional touch module 210 through the connecting circuit. After the traditional touch module 210 receives the instruction sent from the node control module 240, for example, the button of "up stairs" and "down stairs", the traditional touch module 210 follows the steps to inform the traditional control module 610, and then the traditional control module 610 plans a schedule for the vehicle. If the user gives the instruction to the button with the direction indicator light 212, or 214 of the traditional touch module 210, the node control module 240 also receives a signal indicating what instruction was given by the user through the connecting circuit, and further turns on the light corresponding to the direction of the direction control area 233 in the display 231. If the user cancels the instruction to the traditional touch module 210, the node control module 240 also receives a signal indicating what instruction was cancelled by the user through the connecting circuit, and further turns off the light corresponding to the direction of the direction control area 233 in the display 231.

When the vehicle arranged by the traditional control module 610 arrives at the node 160, the traditional control module 610 turns off the button with the direction indicator light 212, or 214 of the traditional touch module 210. When receiving the signal indicating that the button with the direction indicator light 212, or 214 is turned off through the connecting circuit, the node control module 240 may receive the signal indicating that the vehicle has arrived at the node 160. Therefore, the node control module 240 may turn off the light corresponding to the direction within the direction control area 233 of the display 231, and also inform the intelligent control module 620 that the vehicle has arrived at the node 160. The intelligent control module 620 may inform the node control module 240 of another node 160, and send a signal to the second target 236 of the display 231 to display the video signal of the input module 210 of the node which the vehicle stops by. The intelligent control module 620 may also inform the vehicle control module 440, and send a signal to the second target 236 of the display 231 to display the video signal of the input module 210 of the node which the vehicle stops by. The intelligent control module 620 further may inform the intelligent network control center 630 to monitor the signal of the vehicle and the input module 210 of the node which the vehicle stops by.

Similarly, in this embodiment, the traditional touch module 410 and the vehicle control module 440 of the vehicle controller 124 are connected to each other. After receiving the input from the user, the vehicle control module 440 gives the instruction to the node corresponding to the traditional touch module 410 by the connecting circuit. After the traditional touch module 410 receives the instruction from the vehicle control module 440, for example, after pressing the button of "the first floor", the traditional touch module 410 follows the steps to inform the traditional control module 610, and then the traditional control module 610 plans a schedule for the vehicle. If the user gives the instruction to the traditional touch module 410, the vehicle control module 440 also receives a signal indicating what instruction was given by the user through the connecting circuit, and further turns on the light corresponding to the node of the node instruction area 432 in the display 231. If the user cancels the instruction to the traditional touch module 410, the vehicle control module 440 also receives a signal indicating what instruction was cancelled by the user through the connecting circuit, and further turns off the light corresponding to the node of the direction control area 432 in the display 231.

When the vehicle arranged by the traditional control module 610 arrives at a certain node 160, the traditional control module 610 turns off the light of the node of the traditional touch module 410. When receiving the signal indicating the light of the node is turned off by the connecting circuit, the vehicle control module 440 may receive the signal indicating that the vehicle has arrived at the node 160. Therefore, the vehicle control module 440 may turn off the light corresponding to the direction of the node instruction area 432 in the display 231, and also inform the intelligent control module 620 that the vehicle has arrived at the node 160.

Figure 6:
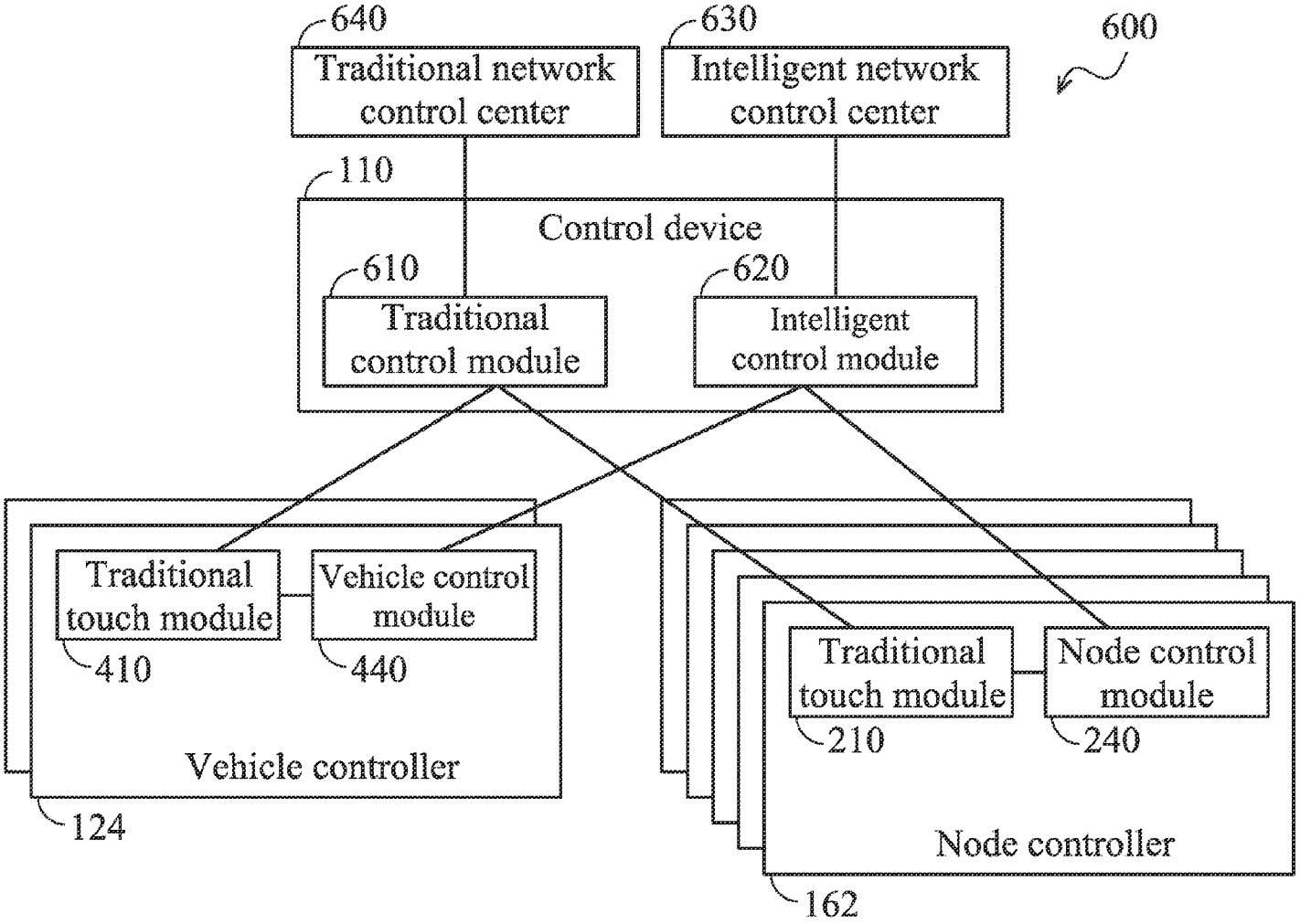
FIG. 6 is a schematic diagram illustrating an embodiment of each component connected in a simple node transportation system of the disclosure.

Because the simple node transportation system 600 may affect the safety of the passengers, the traditional control module 610 has to be authenticated and testes repeatedly. The advantage showed by an embodiment of FIG. 6 is that the new components do not need to be changed or be connected directly to the traditional control module 610. The traditional control module 610 does not have to authenticate and test the security function of the core again. However, the con is that the integration level may be lower and the system reaction may be slower. If the simple node transportation system 600 needs a higher degree of integration functions and faster reaction velocity, the simple node transportation system 600 may use the following mode of the connection.

In addition, in the embodiment of FIG. 6, the simple node transportation system 600 does not install the intelligent control module 620. In an example, as a result of the passengers discharging at some certain nodes 160 being larger, the node controller 162 are merely needed to attach to some nodes 160 for performing the control function by the gestures. In another example, only the vehicle controller 124 may be installed in the simple node transportation system 600. In other words, the vehicle controller 124, the node controller 162, and the intelligent control module 620 may exist alone, or cooperate with each other.

Figure 7:
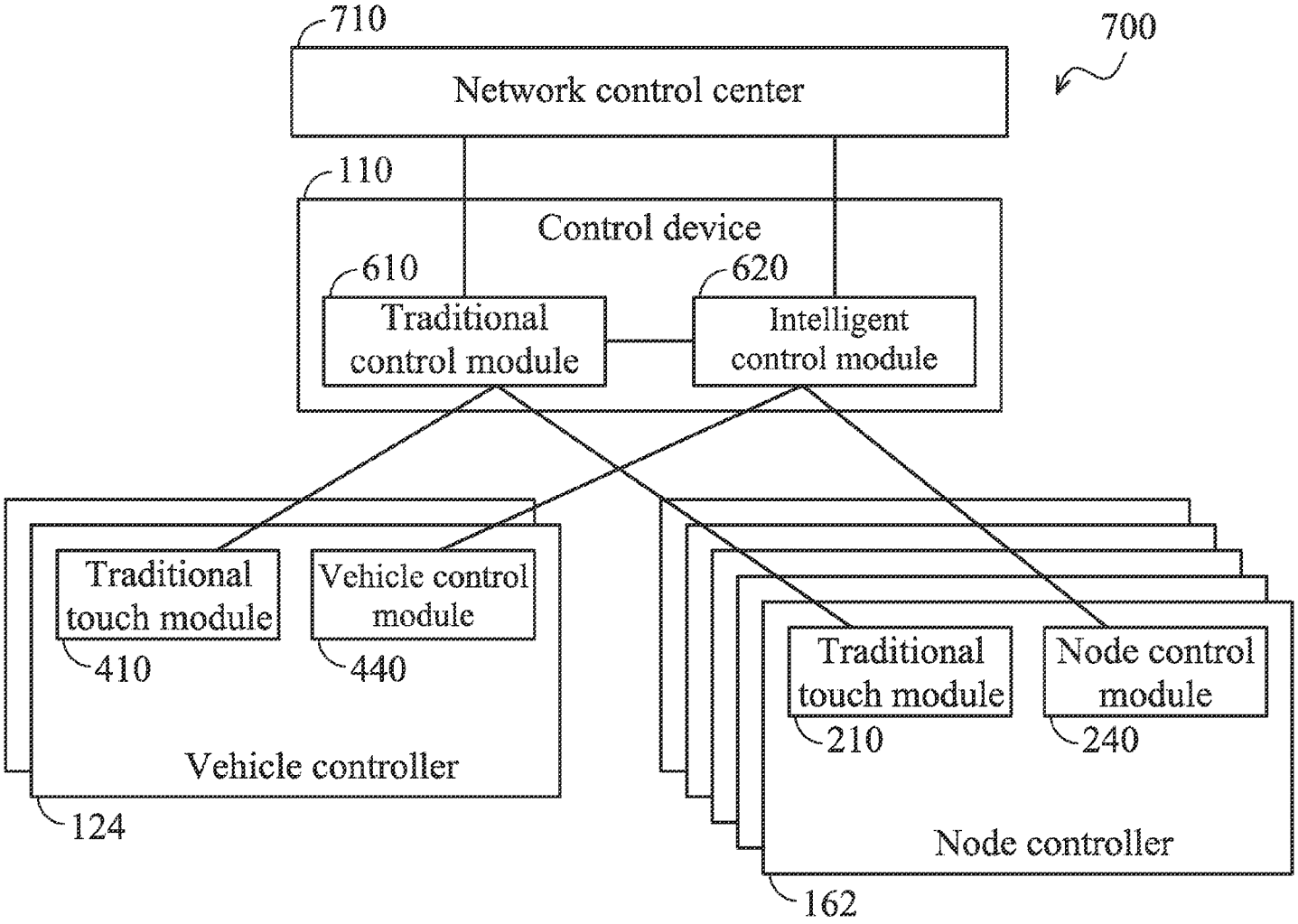
FIG. 7 is a schematic diagram illustrating an embodiment of each component connected in a simple node transportation system of the disclosure.

Please refer to FIG. 7, which shows a diagram illustrating each component connected in a simple node transportation system 700 according to an embodiment of the invention. The main difference between the embodiment of FIG. 7 and FIG. 6 is that the traditional control module 610 of the transportation system 700 and the intelligent control module 620 are connected to each other, while the transportation system 600 is connected to the vehicle and the node. In this embodiment, the traditional control module 610 may output and input the position of the vehicle and the signal indicating that the situation that the users issue instructions in each node. Therefore, the intelligent control module 620 may transmit the information transmitted from the traditional control module 610 to each vehicle controller 124 and each node controller 162, so that the vehicle control module 440 and the node control module 240 corresponding to each vehicle controller 124 and each node controller 162 may be displayed in the node instruction area 432 and the direction control area 233 of the display 231 correctly. The intelligent control module 620 may also transmit the instruction to the traditional control module 610 to arrange for the vehicle according to the input of each vehicle controller 124 and each node controller 162.

It is noted that, in the embodiment of the simple node transportation system 700, the intelligent control module 620 has to be there, but not every vehicle and node have to be installed the vehicle controller 124 and the node controller 162. In addition, the touch module 410 of the traditional vehicle controller 124 and the vehicle control module 440 may also be connected to each other. The traditional touch module 210 of the node controller 162 and the node control module 240 may also be connected to each other.

The simple node transportation system 700 may also comprises a network control center 710, which is connected to the traditional control module 610 and the intelligent control module 620. The network control center 710 may monitor the vehicle and the signal of the input module 210 of the node which the vehicle stops by.

The parts described above all improve the controlling mode of the second form described in the prior art, and the following parts modify the intelligent controlling mode of the first form described in the prior art. The control method of the first form is that the user can input the node 160 which the user wants to go to at the node 160 in advance. After entering the vehicle, the user does not input the node 160 which the user wants to go to.

Figure 8:
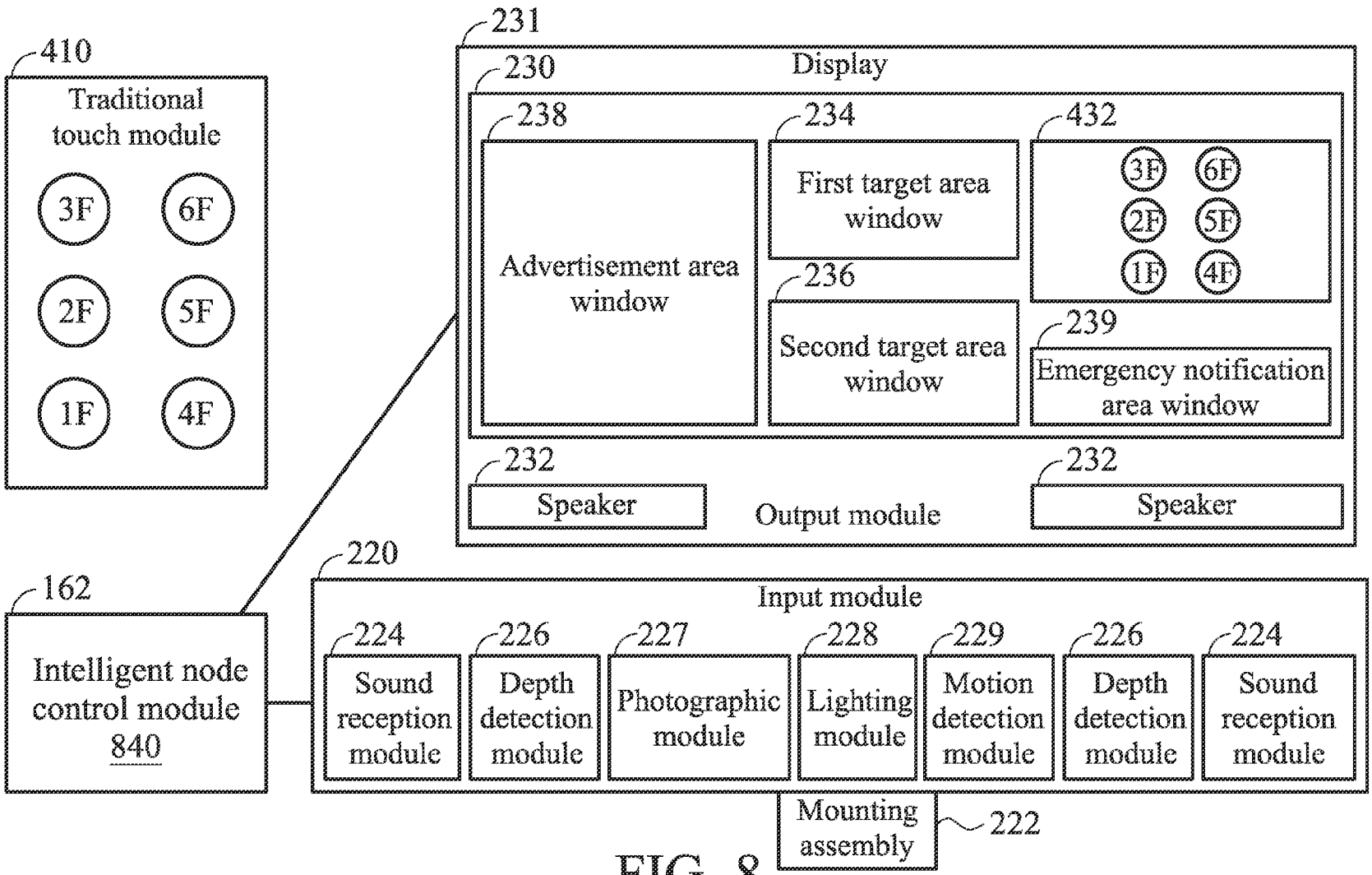
FIG. 8 is a schematic diagram illustrating an embodiment of a node controller of the disclosure.

Please refer to FIG. 8, which shows a diagram illustrating a node controller 162 according to an embodiment of the invention. The node controller 162 of the embodiment is actually very similar to the vehicle controller 124 showed in FIG. 4. The user can choose the node 160 which the user wants to go to through the traditional touch module 410, and also can choose the node 160 which the user wants to go to through the input module 220 and the output module 230 controlled by a intelligent node control module 840. After seeing the previous introduction, a person of ordinary skill should be able to understand the operation mode, and therefore the operation mode is not detailed here.

In the regulation of teaching in some religion, the users which are a different gender can not take the same vehicle. To avoid the problem of sexual harassment between different genders, in an embodiment of the invention, the intelligent node control module 840 may recognize the gender of the user, and further inform the control device 110. Therefore, the control device 110 may arrange for a vehicle to stop by the node 160 appropriately. In another embodiment of the invention, if the genders of the group of the users are different, the intelligent node control module 840 may inform the vehicle that is coming or has stopped by the node 160 contains which gender. If the user of the other gender wants to enter the vehicle, the intelligent node control module 840 may issue a warning and/or notify the remote administrator.

Figure 9:
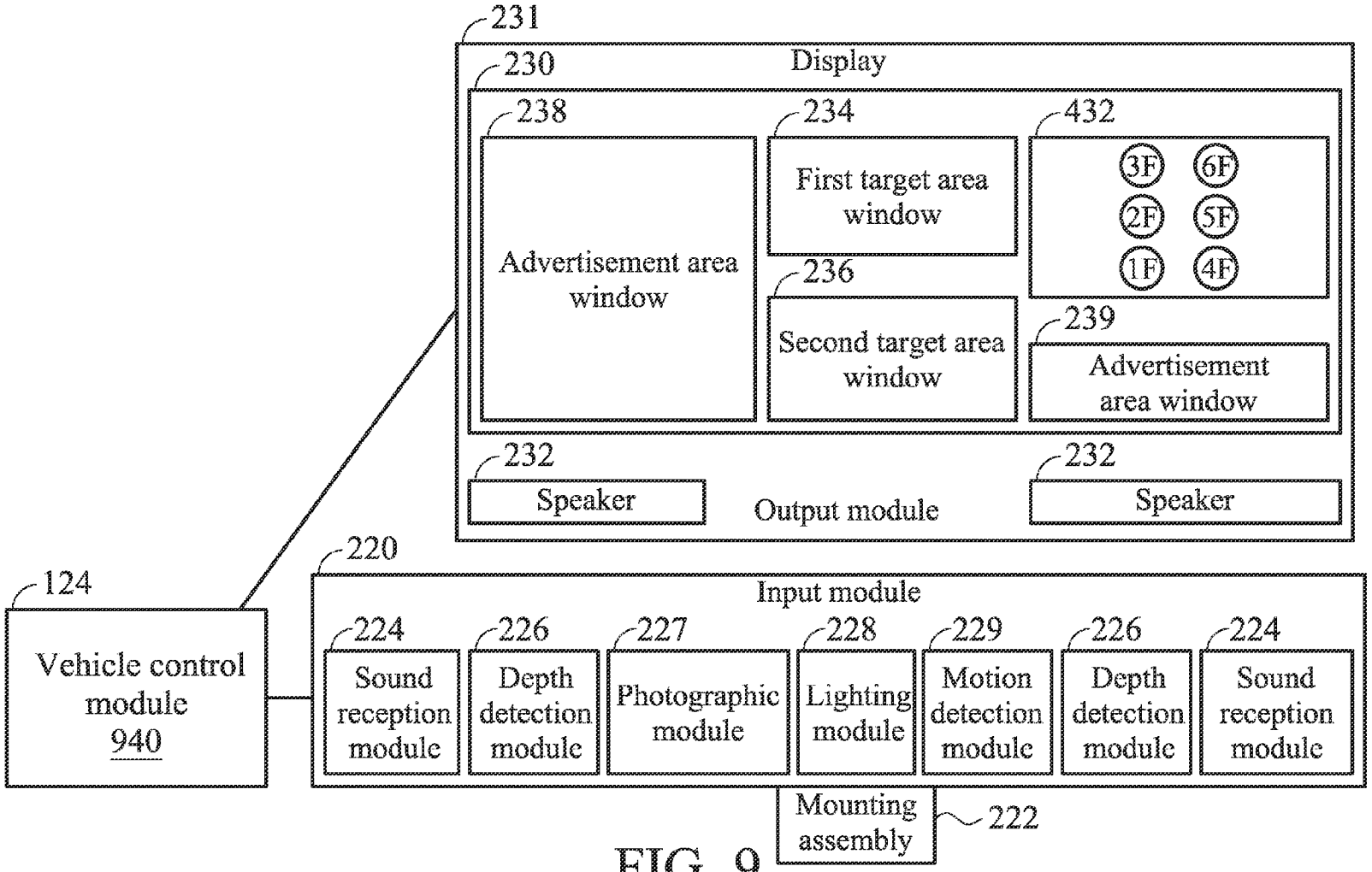
FIG. 9 is a schematic diagram illustrating an embodiment of a vehicle controller of the disclosure.

Please refer to FIG. 9, which shows a diagram illustrating a vehicle controller 124 according to an embodiment of the invention. In the transportation system of the first form, after entering the vehicle, the user does not have to input the node 160 which he wants to go to again, so the vehicle controller 124 is not equipped with the traditional touch module. The vehicle controller 124 of the embodiment is actually very similar to the vehicle controller 124 in FIG. 4. The vehicle control module 940 is also very similar to the vehicle control module 440. The difference is that the vehicle control module 940 does not have to be connected to the traditional touch module 410. After seeing the previous introduction, a person of ordinary skill should be able to understand the operation mode, and therefore the operation mode is not detailed here.

Similarly, if the vehicle has been set for a specific gender, the vehicle control module 940 detects that the user of the other gender has entered the vehicle, and the vehicle control module 940 may issue a warning and/or notify the remote administrator.

Figure 10:
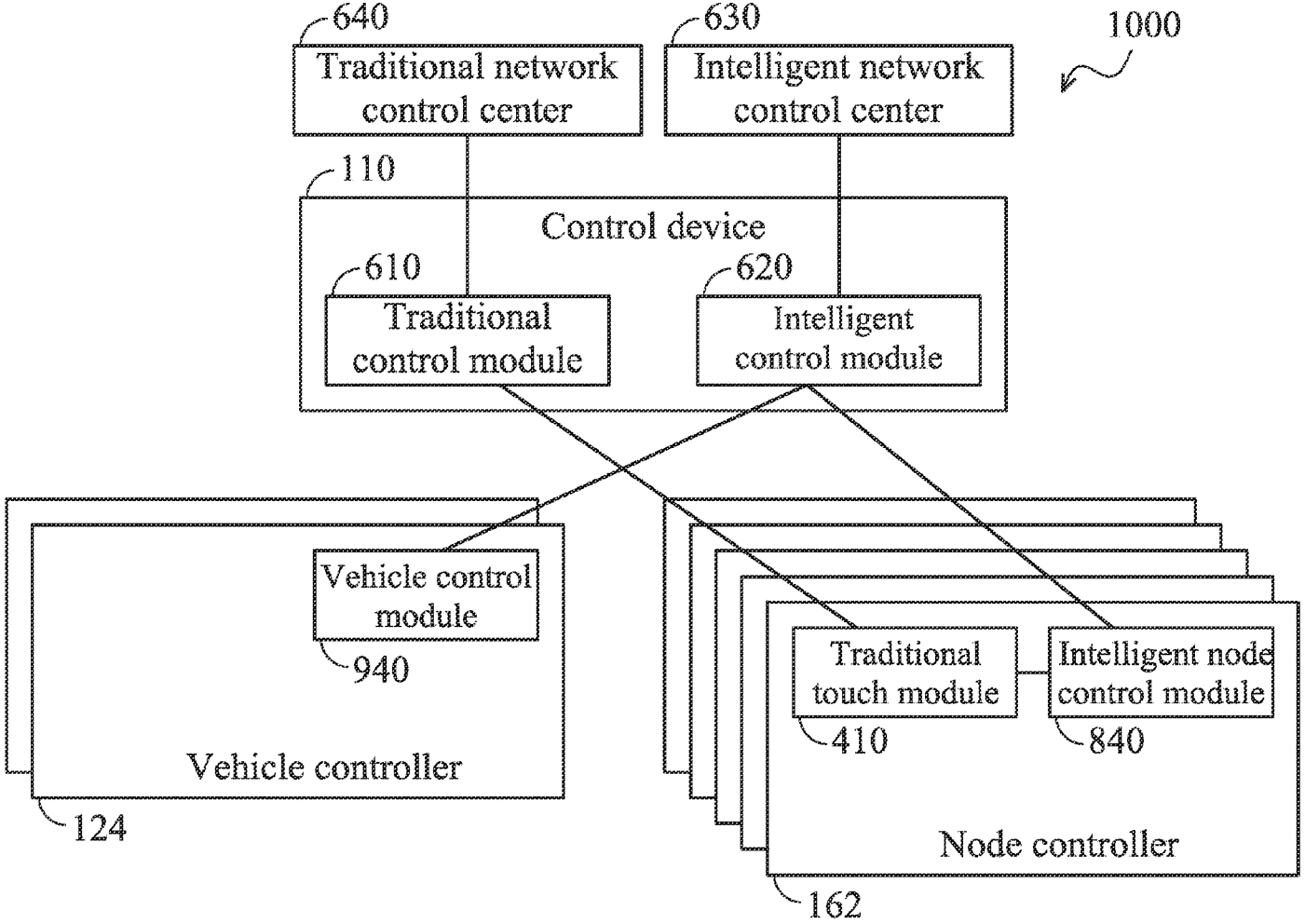
FIG. 10 is a schematic diagram illustrating an embodiment of each component connected in a simple node transportation system of the disclosure.

Please refer to FIG. 10, which shows a diagram illustrating each component connected in a simple node transportation system 1000 according to an embodiment of the invention. FIG. 10 is similar to FIG. 6, wherein the intelligent node control module 840 and the traditional touch module 410 are connected to each other, and there is no traditional touch module in the vehicle.

Figure 11:
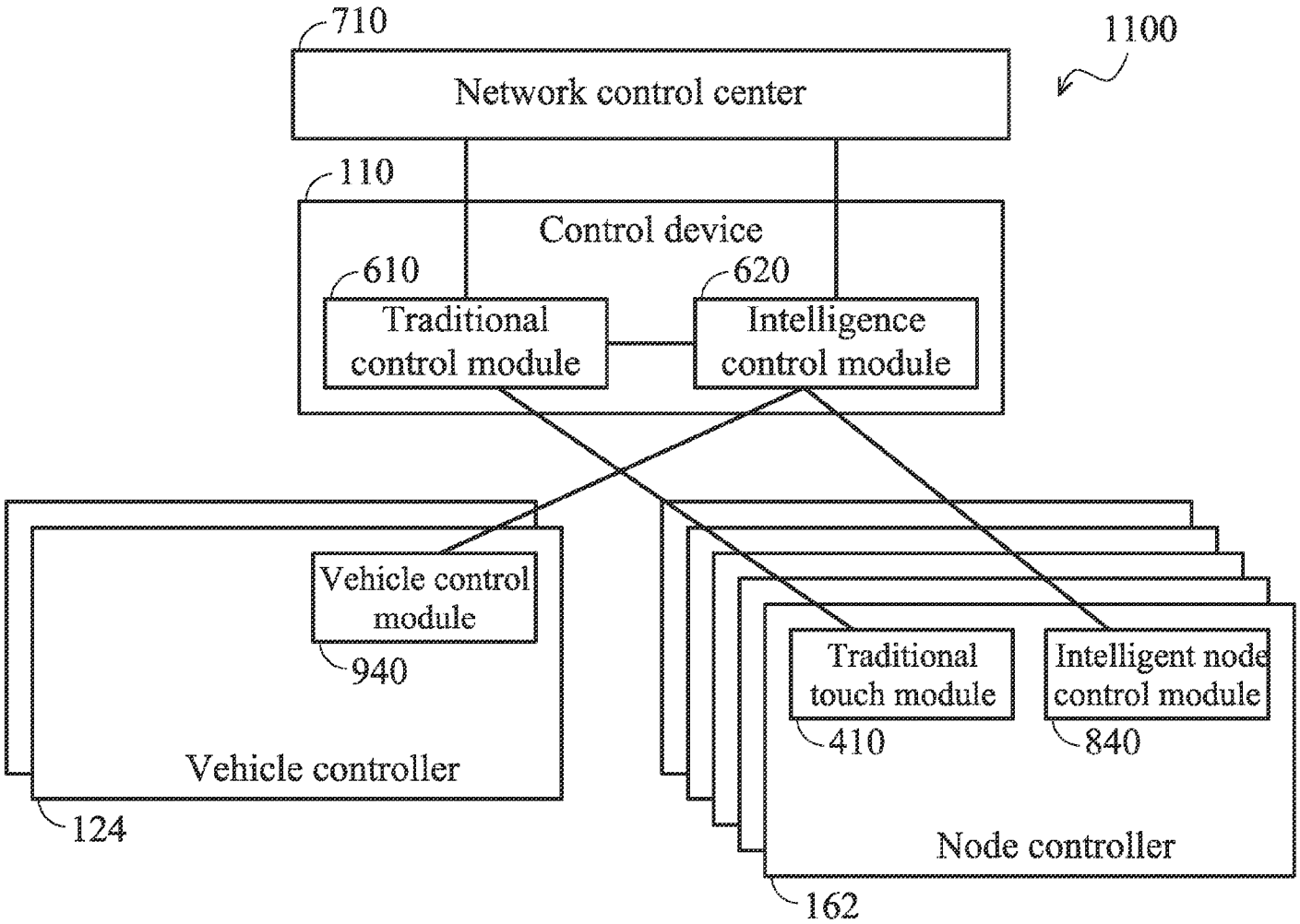
FIG. 11 is a schematic diagram illustrating an embodiment of each component connected in a simple node transportation system of the disclosure.

Please refer to FIG. 11, which shows a diagram illustrating each component connected in a simple node transportation system 1100 according to an embodiment of the invention. FIG. 11 is similar to FIG. 7, wherein the traditional control module 610 of the transportation system 1100 and the intelligent control module 620 are connected to each other.

In an embodiment of the invention, the traditional control module 610 and the intelligent control module 620 supply power respectively. In another embodiment, the power of the traditional touch module 210 and 410 and the traditional control module 610 belong to the same system. In addition to the traditional touch module 210 and 410, the power of each vehicle controller 124 and each node controller 162 and the intelligent control module 620 belong to the same system. Though, these two power systems may be equipped with the uninterruptible power supply device, only one of them has a problem, and the problem does not affect other components of the power system.

Figure 12:
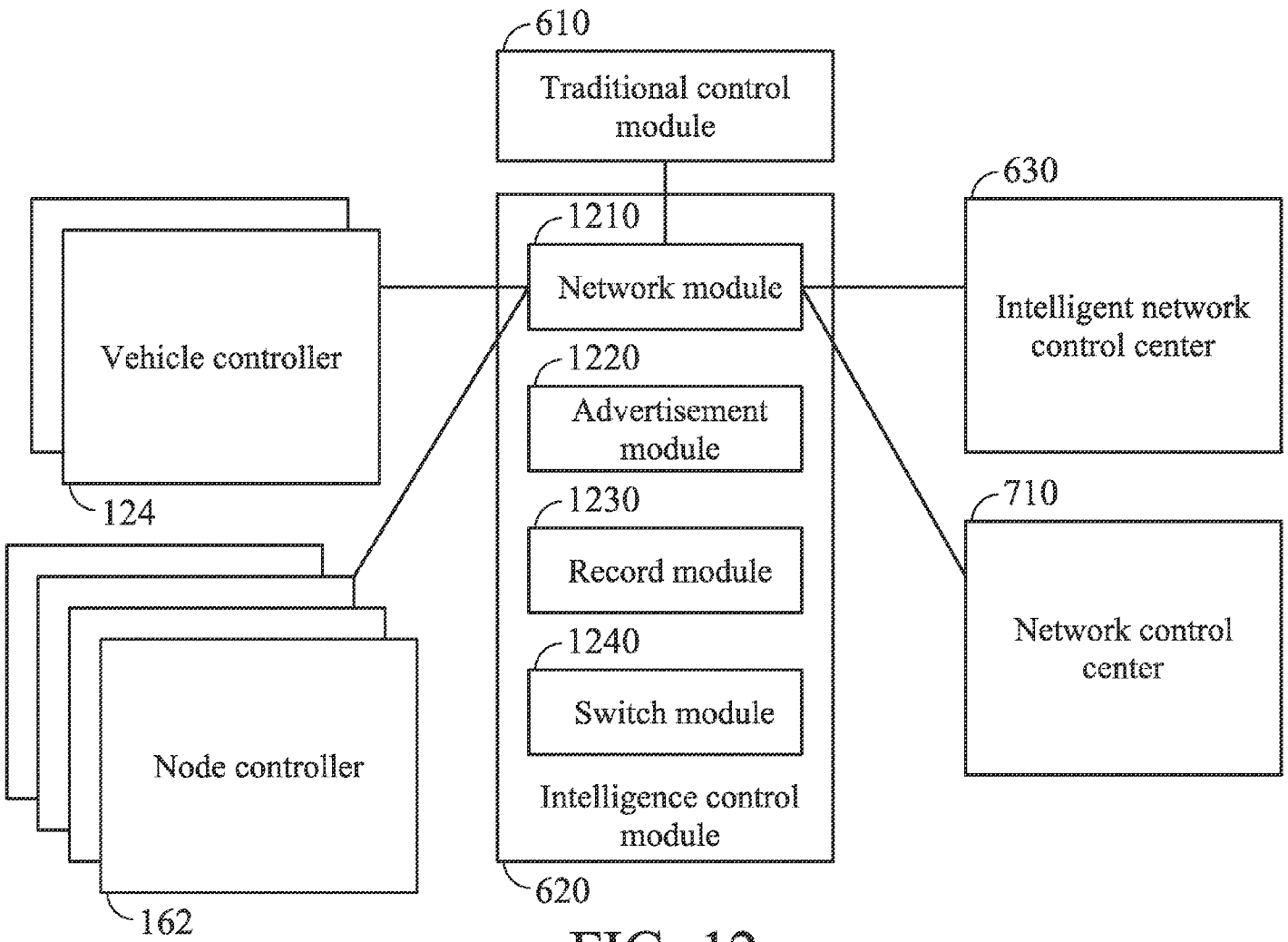
FIG. 12 is a schematic diagram illustrating an embodiment of an intelligent control module of the disclosure.

Please refer to FIG. 12, which shows a diagram illustrating an intelligent control module 620 according to an embodiment of the invention. The intelligent control module 620 may comprise a network module 1210 configured to be connected to each vehicle controller 124 and each node controller 162. In an embodiment, the network module 1210 may be connected to an intelligent network control center 630, the network control center 710 and/or the traditional control module 610.

The intelligent control module 620 may comprise an advertisement module 1220 configured to store various advertisement videos, or receive the signal from other radio broadcast stations for supplying each vehicle controller 124 and each node controller 162 to broadcast in the advertisement area 238 in the display 231. Because each vehicle controller 124 and each node controller 124 may return the image of the user, in an embodiment, the advertisement module 1220 may provide the individual differentiated advertisements according to the user photographed by each vehicle controller 124 and each node controller 162. For example, if the user photographed by a certain node controller 162 is a woman, the advertisement module 1220 may send a signal to the node controller 162 to broadcast the advertisements about cosmetics or costume. If the user photographed by a certain node controller 162 is a man, the advertisement module 1220 may send a signal to the node controller 162 to broadcast the advertisements about cameras or computers.

The intelligent control module 620 may comprises a record module 1230 configured to store various signals recorded by each vehicle controller 124 and each node controller 162, wherein the signals include video signals, audio signals and depth signals. The record module 1230 may determine whether the record module 1230 records the signals or not according to the signals transmitted from the motion detection module 229 of the input module 220. If the motion detection module 229 does not detect any movement, the record module 1230 may not have to record the signal of the vehicle and the node.

The intelligent control module 620 may comprises an switch module 1240 configured to exchange the information with the traditional control module 610. In the embodiment shown in FIG. 7 and FIG. 11, the intelligent control module 620 may exchange the information with the traditional control module 610, and the switch module 1240 is configured to provide the interpretation for transforming signals. In addition, the switch module 1240 may also be configured to connect to any vehicle/node and the intelligent network control center 630/the network control center 710 to let the remote administrator in the intelligent network control center 630/the network control center 710 communicate with the user in the vehicle/node directly.

In conclusion, in addition to the advantages mentioned above, the present invention may also provide at least the following advantages. First, the user does not need to touch any button, and the user can control the simple node transportation system. For example, in health sensitive environments or in hospitals or laboratories needing high infection control, the user can avoid the contact of infection. Furthermore, the simple node transportation system may be inputted with instructions by many users at the same time according to the invention, and does not force the users to squeeze before the conventional touch panel. Especially in a narrow vehicle, the user only lifts a finger, and the user can operate the vehicle. Moreover, the invention may enhance the rate of the attention of the advertisement. The user needs to peer at the display to control the simple node transportation system, and therefore the advertisement in the display may gain higher rate of the attention. If the advertisement is integrated with segment advertisements which may be classified according the passengers, the effect is better than other advertisement machines. Furthermore, the user can see the running situations of the vehicle through the second target area. For example, the current situations of the users pass in and out the vehicle that stops by the node, or the interior situations of the vehicle. The disclosure may provide a better system to know the situations, and avoid users from waiting for the vehicle in the case where they do not know what happened. Finally, the invention may enhance the safety of the system. For example, the setting of the prohibited area may add a layer of insurance on the switches of the security doors, or for example, the system may record the signal at any time and send it to the remote for storing the signal, so that the remote manager can communicate with the user in the node target areas. The above-mentioned examples may enhance the safety of the simple node transportation system.

What is claimed is:

1. A simple node transportation system, comprising:

a vehicle traveling on a route, wherein the route comprises a plurality of nodes which the vehicle may stop by;

a traditional control module, configured to control the vehicle; and any combination of a node controller and a vehicle controller, wherein the node controller is installed in one of the plurality of nodes, and the vehicle controller is installed in the vehicle, and the node controller further comprises:

a traditional touch module, configured to connect to the traditional control module, and send a control instruction of a user to the traditional control module;

an input module, configured to photograph an image in a target area and at least a gesture of the user;

a node control module, configured to recognize the gesture, to transfer the corresponding control instruction, and to output the corresponding control instruction to the traditional control module; and an output module, configured to display the image in the target area and the corresponding control instruction, wherein the vehicle controller further comprises:

the traditional touch module, configured to connect to the traditional control module, and send the control instruction of the user to the traditional control module;

the input module, configured to photograph an interior image in the vehicle and at least a gesture of the user;

a vehicle control module, configured to recognize the gesture, to transfer the control instruction corresponding to the gesture, and to output the control instruction to the traditional control module; and the output module, configured to display the interior image and the control instruction corresponding to the interior image.

2. The simple node transportation system as claimed in claim 1, wherein the computing device further comprises:

an intelligent control module, further comprises a network module configured to connect to any combination of: the node control module of at least a node controller; and the vehicle control module of the vehicle controller, wherein the node control module or the vehicle control module gets the image in the target area photographed by the input module of another node controller or the interior image photographed by the input module of the vehicle controller through the network module, and sends a signal to the output module of the node control module or the vehicle control module to display the image in a target area or the interior image.

3. The simple node transportation system as claimed in claim 2, wherein the corresponding control instruction is sent to the traditional control module through one of the following components:

the traditional touch module; and a switch module of the intelligent control module.

4. The simple node transportation system as claimed in claim 3, wherein the intelligent control module comprises a record module, configured to record the image in the target area photographed by the input module of the node controller connected to the network module or the interior image photographed by the input module of the vehicle controller connected to the network module.

5. The simple node transportation system as claimed in claim 1, wherein the input module further comprises a depth detection module configured to detect the depth signal of the user in the target area, wherein the node control module or the vehicle control module further recognizes the gesture according to the depth signal of the depth detection module.

6. The simple node transportation system as claimed in claim 1, wherein the gesture recognition further comprises any of the following sets:

a single gesture of the same user;

a plurality of gestures of the same user; and a plurality of gestures of a plurality of users.

7. A node controller in a simple node transportation system, wherein the simple node transportation system comprises a vehicle traveling on a route, and a traditional control module configured to control the vehicle, wherein the route comprises a plurality of nodes, which the vehicle may stop by, and the node controller is installed in at least one of the plurality of nodes, the node controller comprises:

an input module, configured to photograph an image in a target area and at least a gesture of the user;

a node control module, configured to recognize the gesture, transfer the corresponding control instruction, and output the corresponding control instruction to the traditional control module; and an output module, configured to display the image in the target area and the corresponding control instruction;

wherein the corresponding control instruction is sent to the traditional control module through one of the following components:

a traditional touch module, installed in the node controller; and an switch module of an intelligent control module, wherein the node control module is connected to a network module of the intelligent control module;

wherein the input module further comprises a photographic module and a depth detect module configured to photograph the image in a target area and at least a gesture of the user, wherein the depth detect module is configured to limit the depth of the target area, wherein the node control module recognizes the gesture further according to the depth signal output from the depth detect module, and the input module further comprises any set of the following components:

a sound reception module, configured to receive at least one sound channel;

a lighting module, configured to light the target area; and a motion detection module, configured to make all or a part of the whole input module or the node controller start through the node control module if an object is detected in the target area.

8. The node controller as claimed in claim 7, wherein the gesture recognition further comprises any of the following sets:

a single gesture of the same user;

a plurality of gestures of the same user; and a plurality of gestures of a plurality of the users.

9. A vehicle controller in a simple node transportation system, wherein the simple node transportation system comprises a vehicle traveling on a route, and a traditional control module configured to control the vehicle, wherein the route comprises a plurality of nodes, which the vehicle may stop by, and the vehicle controller is installed in the vehicle, the vehicle controller comprises:

an input module, configured to photograph an interior image in the vehicle and at least a gesture of the user;

a vehicle control module, configured to recognize the gesture, transfer the corresponding control instruction, and output the corresponding control instruction to the traditional control module; and an output module, configured to display the interior image in the vehicle and the corresponding control instruction;

wherein the corresponding control instruction is sent to the traditional control module through one of the following components:

a traditional touch module installed in the vehicle where the vehicle controller is; and an switch module of an intelligent control module, wherein the vehicle control module is connected to a network module of the intelligent control module;

wherein the input module further comprises a photographic module and a depth detect module configured to photograph the interior image in the vehicle and at least a gesture of the user, wherein the depth detect module is configured to limit the depth of the target area, and the vehicle control module recognizes the gesture further according to the depth signal output from the depth detect module, and the input module further comprises any set of the following components:

a sound reception module, configured to receive at least one sound channel;

a lighting module, configured to light the interior in the vehicle; and a motion detection module, configured to make all or a part of the whole input module or the vehicle controller start through the vehicle control module if an object is detected in the target area.

10. The vehicle controller as claimed in claim 9, wherein the gesture further comprises any of the following sets:

a single gesture of the same user;

a plurality of gestures of the same user; and a plurality of gestures of a plurality of the users.

* * * * *